US006878498B2

(12) United States Patent
Yoshino et al.

(10) Patent No.: US 6,878,498 B2
(45) Date of Patent: Apr. 12, 2005

(54) ELECTROSTATIC LATENT IMAGE DEVELOPING TONER, ITS PRODUCTION METHOD, DEVELOPER, IMAGE-FORMING DEVICE AND IMAGE-FORMING METHOD

(75) Inventors: Susumu Yoshino, Minamiashigara (JP); Koutarou Yoshihara, Minamiashigara (JP); Masanobu Ninomiya, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 109 days.

(21) Appl. No.: 10/607,172

(22) Filed: Jun. 27, 2003

(65) Prior Publication Data

US 2004/0091800 A1 May 13, 2004

(30) Foreign Application Priority Data

Nov. 12, 2002 (JP) ..... 2002-328590

(51) Int. Cl.[7] ..... G03G 9/00

(52) U.S. Cl. ..... 430/108.1; 430/137.18; 430/137.14; 399/252

(58) Field of Search ..... 430/108.1, 137.18, 430/137.14; 399/252

(56) References Cited

U.S. PATENT DOCUMENTS

| | | | | |
|---|---|---|---|---|
| 6,187,497 | B1 * | 2/2001 | Kushi et al. | 430/110.4 |
| 6,453,146 | B1 * | 9/2002 | Yamada et al. | 399/350 |
| 6,613,491 | B2 * | 9/2003 | Inoue et al. | 430/110.3 |

FOREIGN PATENT DOCUMENTS

| | | |
|---|---|---|
| JP | A 56-125751 | 10/1981 |
| JP | A 62-184469 | 8/1987 |
| JP | A 62-267766 | 11/1987 |
| JP | A 3-100661 | 4/1991 |
| JP | A 4-40471 | 2/1992 |
| JP | A 4-274442 | 9/1992 |
| JP | A 5-94113 | 4/1993 |
| JP | A 6-11883 | 1/1994 |
| JP | A 6-266152 | 9/1994 |
| JP | A 6-308759 | 11/1994 |
| JP | A 7-28276 | 1/1995 |
| JP | A 4-328757 | 11/1995 |
| JP | B2 7-120086 | 12/1995 |
| JP | A 8-44220 | 2/1996 |
| JP | A 8-115007 | 5/1996 |
| JP | A 9-194593 | 7/1997 |
| JP | A 9-197705 | 7/1997 |
| JP | A 9-319134 | 12/1997 |
| JP | A 10-213977 | 8/1998 |
| JP | A 10-312089 | 11/1998 |
| JP | A 9-197706 | 7/1999 |
| JP | A 11-338183 | 12/1999 |
| JP | A 2001-66820 | 3/2001 |
| JP | A 2001-163985 | 6/2001 |

* cited by examiner

*Primary Examiner*—Mark A. Chapman
(74) *Attorney, Agent, or Firm*—Oliff & Berridge, PLC

(57) ABSTRACT

An electrostatic latent image developing dry toner and the like are provided, in which toner remaining after transfer can be recovered during developing with or without having a blade cleaning stage for promoting friction of an electrostatic latent image holding member. The electrostatic latent image developing toner contains toner particles containing a binder resin and a colorant and monodisperse resin particles having a volume mean diameter of 80 to 300 nm, a gel ratio of 60% or more by weight, and a standard deviation of D50×0.20 or less. A method of producing the above toner first mixes monodisperse resin particles, which have a volume mean diameter of 80 to 300 nm, a gel ratio of 60% or more by weight, and a standard deviation of D50×0.20 or less, with toner particles containing a binder resin and a colorant, and adds an inorganic compound having a diameter smaller than that of the resin particles with a shear lower than the first mixing.

20 Claims, 2 Drawing Sheets

ELECTROSTATIC LATENT IMAGE DEVELOPING TONER, ITS PRODUCTION METHOD, DEVELOPER, IMAGE-FORMING DEVICE AND IMAGE-FORMING METHOD

BACKGROUND OF THE INVENTION

1. Field of the Invention

The present invention relates to a toner used for developing an electrostatic latent image, a method of producing such a toner, a developer, an image-forming device and an image-forming method which are used for electrophotography, and an electrostatic recording method.

2. Description of the Related Art

In electrophotography, an electrostatic latent image, which is formed on a latent image holding member (photoreceptor), is developed with a toner containing a colorant, the obtained toner image is transferred onto a transfer material and fixed by a heat roller or the like to create an image, and the latent image holding member is cleaned so that another electrostatic latent image can be formed. Dry developers used for the electrophotography or the like can be broadly divided into single-component developers which solely use a toner having a colorant or the like mixed with a binder resin and two component developers having a carrier mixed with a toner as described. Single-component developers may in turn be classified into those comprising single magnetic components having a magnetic powder and are transported for development to a developer holding member by magnetic force, and those comprising a single nonmagnetic component not having magnetic powder and which are transported to a developer holding member for development after being charged by a charging roller or the like.

Since around the latter half of the 1980's, there has been a great demand for reduction in size and increased performance for digitalization of the electrophotography market, and particularly a demand for full-color images of a quality similar to that of high-grade printing and silver-salt film photos.

Digitalization processing is necessary to achieve high image quality. Image digitalization in turn requires complex image processing at a high speed. With digitalization, it becomes possible to separately control characters and photo images, and reproducibility and quality of both has improved remarkably as compared with concurrent improvements in analog technology. Especially, the improvement is remarkable in that it has become possible to make gray level correction and color correction of a photo image, and it is advantageous over the analog technology in terms of a gradation property, fineness, sharpness, color reproduction, and graininess. However, output of an image requires forming the image faithfully from a latent image which is formed by the optical system. Meanwhile, although toner particle size has become smaller, and studies to provide accurate reproducibility have been promoted, it has not proved possible to obtain reliable high image quality simply by reducing the size of toner particles. Corresponding improvement in the basic properties of the developing, transfer, and fixing properties is also necessary.

Especially in color imaging, in which a color image is formed by superposing three or four colored toners, if any one of the toners does not perform as expected in terms of developing, transfer, and fixing properties, or performs different from the other colors, degradation of image quality such as deterioration of color reproduction, deterioration of graininess, uneven color, or the like may occur. To maintain an image having the same stable high quality as the initial quality after a lapse of time, it is important to stably control the properties of individual colors.

Japanese Patent Application Laid-Open (JP-A) No. Hei 10-312089 discloses that the toner is stirred in the developing unit, a fine structure of the toner surface is easily varied, and transferability is considerably changed.

Lately, for miniaturization of the device to save space, reduction of toner waste for environmental protection, and elongation of the service life of the latent image holding member, there is proposed a cleaner-free system in, for example, JP-A No. Hei 5-94113. The system disclosed in that publication does not have a cleaning system, the toner remaining on the photosensitive drum after image transfer is dispersed by a brush which is in contact with the photosensitive drum, and the dispersed toner is simultaneously recovered by the developing unit during the developing phase. Generally, when the residual toner is recovered during developing, there is a disadvantage that the recovered toner and the other toner have different electrostatic properties, and the recovered toner is normally not used for developing but is instead accumulated in the developing unit. It therefore remains necessary to improve the transfer efficiency so to control to minimize the amount of toner to be recovered.

JP-A No. Sho 62-184469 proposes use of a toner having a spherical shape in order to improve flowability, electrostatic properties, and transferability. However, when the toner has a spherical shape, certain disadvantages result. The developing unit is provided with a conveying amount control panel for controlling a conveying developer amount to a prescribed level. This control can be effected by varying a space between the magnetic roller and the conveying amount control panel. However, when a spherical toner is used, along with improvement in flowability of the developer, the set bulk density also becomes high. As a result, developer puddles are formed on the conveyance control section, and there is a phenomenon that a conveying amount becomes instable. Although the conveying amount can be improved by controlling the surface roughness of the magnetic roller and also by narrowing the space between the control panel and the magnetic roller, the packing property is enhanced because of the developer puddles, and an increasing stress is applied to the toner. Thus, the fine structure of the toner surface changes easily, and particularly burying or peeling of an external additive easily occurs. Thus, it is confirmed that there is a disadvantage that development and transferability become largely different from the initial ones.

In an attempt to address such disadvantages, JP-A No. Hei 6-308759 discloses that a superior image quality can be achieved by suppressing the packing property by combining a spherical toner and a non-spherical toner. Although the disclosed method is effective in terms of suppression of the packing property, because the non-spherical toner tends to remain as untransferred toner, high transfer efficiency cannot be achieved. When developing and recovery are performed simultaneously, the composite ratio of the non-spherical toner increases because a disproportionate amount of the untransferred non-spherical toner is recovered, and transfer efficiency is steadily lowered.

To improve the developability, transferability, and cleanability of the spherical toner, JP-A No. Hei 3-100661 discloses that two types of inorganic fine particles having different particle sizes, specifically particles having an average particle size of 5 mμ or more and less than 20 mμ and particles having an average particle size of 20 mμ or more and 40 mμ or less, are used together and added in prescribed amounts. Although initially such a combination of particles provides high developability, transferability, and cleanability, because the force applied to the toners over time cannot be reduced, burying or peeling of the external additive occurs, and development and transferability can greatly vary from initial characteristics.

Meanwhile, JP-A No. Hei 7-28276, JP-A No. Hei 9-319134, and JP-A No. Hei 10-312089 disclose that use of inorganic fine particles having a large particle size can effectively suppress burying of the external additive in the toner as a result of such stress.

In the above publications, because the inorganic fine particles have large specific gravities, peeling or the like of the external additive cannot be avoided because of a stirring stress within the developing unit when the external additive particles become large. Also, when the inorganic fine particles adhere to the toner surface, maintaining a prescribed level of bead chains of the external additive to becomes difficult because the inorganic fine particles do not have a perfect spherical shape. Thus, the shapes of microscopically protruding surfaces serving as spacers vary and selectively suffer from a stress on their protruded portions, so that burying or peeling of the external additive is further accelerated and the spacer effect is insufficient. In order to avoid such disadvantages, JP-A No. 2001-66820 discloses use of monodisperse spherical silica having a low specific gravity. Although spacer effects can be obtained when such silica is used, defects are created in the organic photoreceptor surface due to abrasion of silica when a mechanical pressure is produced during cleaning by the blade, or by the electrostatic brush after transfer, or produced because of a peripheral speed different from a photoreceptor when a charging roller is used for a contact type charger. The number and size of defects increases over time, with the result that the incidence of defective images tends to increase as the device is used.

JP-A No. Hei 6-266152 discloses a technology for adding organic fine particles of 50 to 200 nm to the toner to produce an effective spacer capability. Initially effective spacer capability can be created through use of spherical organic fine particles. The organic fine particles are not susceptible to burying or peeling by stress over time, but do not maintain a high spacer capability with stability because the organic fine particles disclosed in this publication are deformed. The spacer effect may be obtained by adhering a large amount of organic fine particles to the toner surface or by using the organic fine particles having a large particle size. When this is done, the properties of the organic fine particles are largely reflected. Specifically, effects on the powder properties, such as inhibition of flowability and a deterioration of heat cohesion of the toner with inorganic fine particles added and effects on charging and development that a degree of flexibility to control in terms of charging, are impaired because the organic fine particles themselves have charge-imparting capability. To compensate for the disadvantage that the organic fine particles themselves are deformed, there has been proposed resin fine particles having Vickers hardness of 3 to 50 kg/mm and a flat particle size of 0.03 to 1.0 μm in JP-A No. Hei 4-274442, a melamine-based resin in JP-A No. Hei 4-328757, particular crosslinking organic fine particles in JP-A No. Hei 6-11883, organic and inorganic composite particles in JP-A No. Hei 9-194593, JP-A No. Hei 9-197705 and JP-A No. Hei 9-197706, organic fine particles of a substantially spherical cross-linked copolymer of 0.2 μm or less in JP-A No. Hei 11-338183, and crosslinking organic fine particles having a Cv value of particle size of 20% or less and a gel ratio of 25% or more in JP-A No. 2001-163985.

The above patent publications JP-A No. Hei 4-274442, JP-A No. Hei 4-328757, JP-A No. Hei 6-11883, JP-A No. Hei 9-194593, JP-A No. Hei 9-197705, JP-A No. Hei 9-197706 and JP-A No. Hei 11-338183 describe improvements to the transferability of the particles to some extent, but all require the addition of an excessively large amount of particles to the toner because grain size distribution of particles is extensive. Thus, the above-described charging and development are greatly affected, and, when the amount of added particles is reduced, sufficient transferability cannot be obtained. Because the particles in the above references have a small electrostatic property, the melamine-based resin particles of JP-A No. Hei 4-328757 specifically having a positive electrostatic property, they adversely affect imaging because they cause a charging level of the negative charged toner to fall precipitously. Because the particles of JP-A No. 2001-163985 have hardness to some extent and a narrow grain size distribution, transferability is improved when a relatively small amount of the particles are added, but there is still an adverse effect that charging is small.

There is now a great demand for colorizing and an even greater demand for on-demand printing, and there is reported a method in which multi-color images are formed on a transfer belt to copy multiple sheets at a high speed and transferred and fixed onto an image fixing material by a single operation (e.g., JP-A No. Hei 8-115007). When it is assumed that a step of transferring from the photoreceptor to the transfer belt is a primary transfer and a step of transferring from the transfer belt to the transfer material is a secondary transfer, the transfer is repeated twice, and the significance of a technology for improving transfer efficiency grows more important. Because the secondary transfer involves the transfer of multiple color images in a single operation, with the properties of the transfer material (e.g., paper thickness, surface property, etc.) being variable to a certain extent, it is necessary to tightly control the charging, developing, and transferring in order to reduce the influence of the transfer material on the resulting image.

To reduce power consumption and space and to produce higher quality images, there are disclosed technologies of simultaneously transferring and fixing colors onto the intermediate transfer material (e.g., JP-A No. Hei 10-213977 and JP-A No. Hei 8-44220). In this regard, it is important that the transfer belt is provided with transfer capability and fixing capability. Specifically, a thin belt made of a belt material having high heat resistance is used because it is necessary to improve transferability at the primary transfer portion in a cooled state and to instantaneously conduct heat at the secondary transfer and fixing portion. The toner must be fixed under a low pressure because transfer efficiency cannot be controlled to a very high level and a high pressure cannot be applied at the time of fixing. It is also important that contamination caused by the toner when fixing or by an external additive or the like be minimized because the belt surface also has a transfer function.

Meanwhile, there are also proposed methods of faithfully reproducing high image quality, and particularly a half tone, a solid black area or characters by controlling volume specific resistance of the carrier (e.g., JP-A No. Sho 56-125751, JP-A No. Sho 62-267766, Japanese Patent Publication No. Hei 7-120086). Such methods adjust the resistance according to a type of carrier-coated layer or a coated amount and can initially provide a target volume specific resistance and develop high image quality. However, the carrier-coated layer suffers from susceptibility to peeling or the like, and volume specific resistance varies greatly, because of stress in the developing unit. It is therefore difficult to maintain high image quality over a long period of time.

There is also proposed a method of adjusting volume specific resistance by adding carbon black to the carrier-coated layer (e.g., JP-A No. Hei 4-40471). Although this method can effectively suppress changes in volume specific resistance caused by peeling of the coated layer, the external additive added to the toner or the toner components adheres to the carrier, causing changes in the volume specific resistance of the carrier, and therefore impairing expression of high image quality over a long period, as is the case of the above-described carrier.

SUMMARY OF THE INVENTION

The present invention has been achieved in view of the circumstances of the above-described known technologies. The present invention provides a dry toner for developing an electrostatic latent image, an associated production method, and an electrostatic latent image developer using the toner, wherein a stoner toner flowability, electrostatic property, developability, transferability and fixing property, can be maintained over a long period of use. Particularly, a blade cleaning stage which promotes abrasion of the latent image holding member may be provided or omitted, untransferred toner is recovered during developing, and a disadvantage of using an electrostatic brush to recover the toner remaining on the latent image holding member can be avoided. Another object of the invention is to provide an image-forming method which can provide developing, transfer, and fixing which meets the demand for high image quality.

The present inventors have made a devoted study to find that the above objects can be achieved by using a particular additive and completed the present invention.

Specifically, the present invention discloses the following:

(1) An electrostatic latent image developing toner which contains toner particles containing a binder resin and a colorant and resin particles having a volume mean diameter of 80 to 300 nm, a gel ratio of 60% or more by weight, and a standard deviation of D50×0.20 or less, wherein:

Gel ratio=(Weight of resin particles not dissolved in organic solvent/Weight of resin particles used for sample)×100

(2) A method for production of an electrostatic latent image dry toner by first mixing resin particles having a volume mean diameter of 80 to 300 nm, a gel ratio of 60% or more by weight, and standard deviation of D50×0.20 or less to toner particles containing a binder resin and a colorant, and adding to mix an inorganic compound having a diameter smaller than that of the resin particles with shearing lower than that for the mixing.

(3) An electrostatic latent image developing developer comprising a carrier and a toner, wherein the carrier has a resin-coated layer, which has a conductive material dispersed within a matrix resin, on a core material, and the toner contains a binder resin and a colorant and also contains toner particles having a shape with a shape factor SF1 of 100 to 140 and an additive. The additive contains resin particles having a volume mean diameter of 80 to 300 nm, a gel ratio of 60% or more by weight, and a standard deviation of D50×0.20 or less.

(4) An image-forming method for forming an image using an image-forming device which includes a latent image holding member, charging means for charging the surface of the latent image holding member, latent image-forming means for forming an electrostatic latent image on the surface of the charged latent image holding member, developing means for developing the electrostatic latent image with the toner, transfer means for transferring the toner image formed by developing onto a recording medium, wherein the toner contains toner particles, which contain the binder resin and the colorant, and resin particles having a volume mean diameter of 80 to 300 nm, a gel ratio of 60% or more by weight, and a standard deviation of D50×0.20 or less.

DETAILED DESCRIPTION OF THE INVENTION

Figure 1:
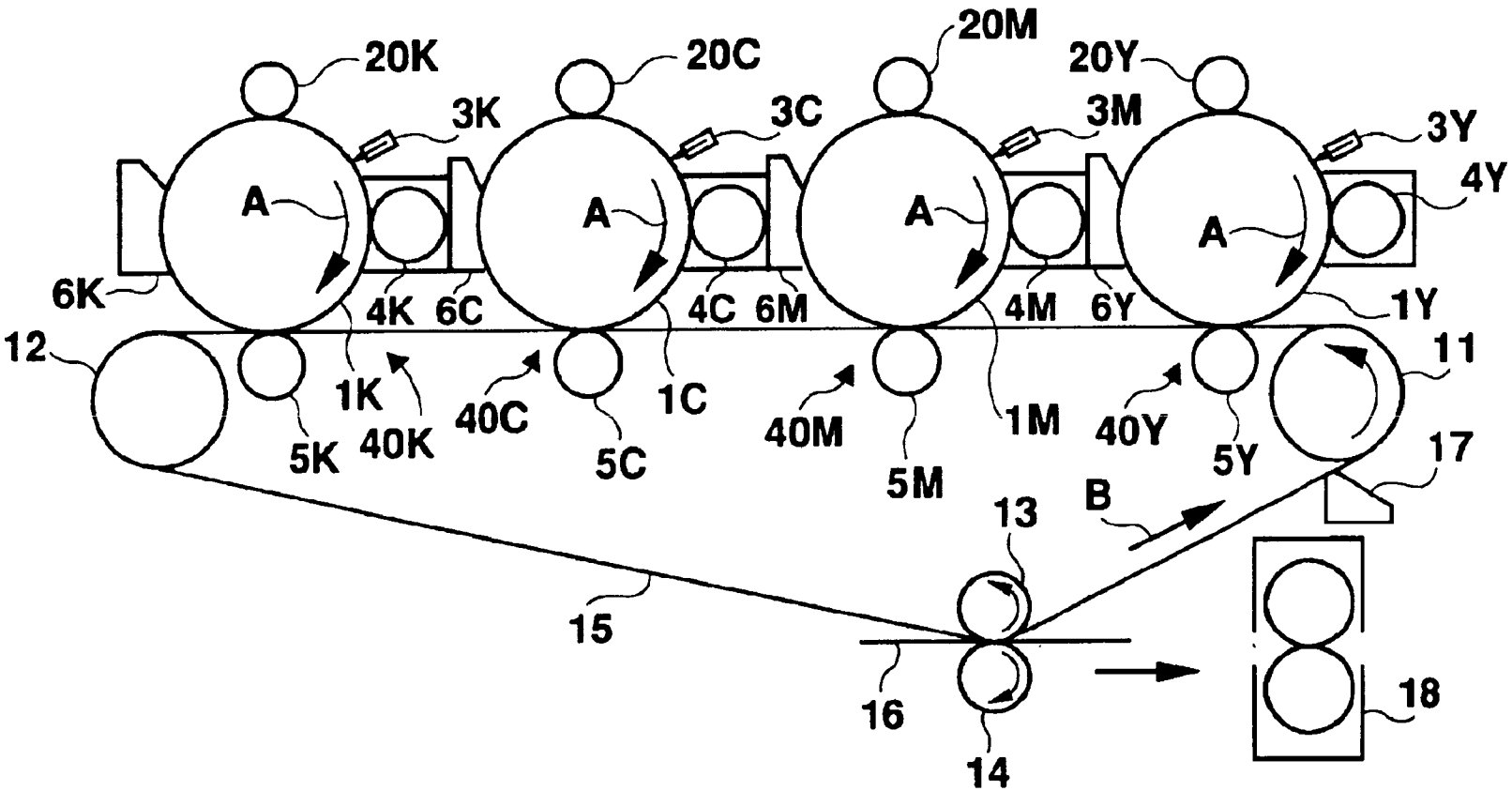
FIG. 1 is a schematic sectional view showing an example of the image-forming device used for the present invention.

The best mode of carrying out the present invention will be described in detail below.

Toner

A toner according to the present invention contains toner particles, which contain a binder resin and a colorant, and resin particles having a volume mean diameter of 80 to 300 nm and high hardness. Components forming the toner will be described in detail below.

[Resin Particles]

The resin particles contained in the toner according to the invention are obtained by, for example, drying an emulsion which is prepared by emulsion-copolymerization of a styrene-based monomer and a monomer having at least two ethylene-based unsaturated groups within molecules in water or a dispersing medium containing water as a main component. Water used as the dispersing medium is preferably ion-exchange water or pure water. Here, the dispersing medium having water as a main component is a mixture aqueous solution of water, an organic solvent such as methanol, a surfactant, an emulsifying agent, or a water-soluble polymeric protective colloid such as polyvinyl alcohol.

The surfactant, the emulsifying agent, or the protective colloid may be reactive or non-reactive as long as they do not obstruct the achievement of the present invention, and may be used alone or in any combination of two or more.

Examples of the reactive surfactant include an anionic reactive surfactant, a nonionic reactive surfactant and the like, which have a radical polymerizable propenyl group introduced. Such reactive surfactants may be used alone or in combination of two or more.

The styrene-based monomers employed in the present invention may be, for example, styrene, α-methylstyrene, β-methylstyrene, o-methylstyrene, m-methylstyrene, p-methylstyrene, p-ethylstyrene, 2,4-dimethylstyrene, 2,5-dimethylstyrene, 3,4-dimethylstyrene, 3,5-dimethylstyrene, 2,4,5-trimethylstyrene, 2,4,6-trimethylstyrene, p-n-butylstyrene, p-t-butylstyrene, p-n-hexylstyrene, p-n-octylstyrene, p-n-dodecylstyrene, p-methoxystyrene, p-phenylstyrene, p-chlorostyrene, 3,4-dichlorostyrene and potassium styrenesulfonate. Among these, styrene is notably suitable for the present invention. The above-listed styrene-based monomers may be used alone or in combinations of two or more.

The monomer having at least two ethylene based unsaturated groups (hereinafter referred to as the "ethylene unsaturated group-containing monomer") for use in the present invention may be, for example, divinylbenzene, divinyltoluene, ethylene glycol di(meta)acrylate, ethylene oxide di(meta)acrylate, tetraethylene oxide di(meta) acrylate, 1,6-hexanediol diacrylate, neopentyl glycol diacrylate, trimethylolpropane tri(meta)acrylate, tetramethylol methanetriacrylate or tetramethylolpropane tetra(meta) acrylate. Such ethylene unsaturated group-containing monomers may be used alone or in combination of at two or more. Here, "(meta acrylate" refers to "acrylate" or "methacrylate".

The ethylene unsaturated group-containing monomers serve as crosslinking monomers to contribute to improvement of a gel ratio of resin fine particles obtained at the time of emulsion copolymerization with the above-described styrene based monomer.

A copolymerization ratio of the styrene-based monomer and the ethylene unsaturated group-containing monomer is not limited to a particular level, but ratio of the ethylene unsaturated group-containing monomer (as a crosslinking monomer) to 100 parts by weight of the styrene based monomer is preferably between 0.5 and 100 parts by weight, and more preferably between 20 and 100 parts by weight. When a ratio of the ethylene unsaturated group-containing monomer to 100 parts by weight of the styrene-based monomer is less than 0.5 part by weight, a gel ratio of the obtained fine particles may not be improved sufficiently. Meanwhile, when the ratio of the ethylene unsaturated group-containing monomer to 100 parts by weight of the styrene-based monomer exceeds 100 parts by weight, there are disadvantages that it is difficult to adjust the particle size and to stably control the particle size to fall in a range of 80 to 300 nm.

According to the invention, a polymerization initiator may be used to promote the emulsion copolymerization of the styrene-based monomer and the ethylene unsaturated group-containing monomer by a radical polymerization reaction.

Examples of the polymerization initiator include a hydrogen peroxide solution and persulfate such as ammonium persulfate, potassium persulfate, sodium persulfate, and the like. Such polymerization initiators may be used alone or in combination of two or more.

Production of an emulsion by the emulsion copolymerization to obtain the resin fine particles of the present invention is not limited to a particular method, and the following procedure may be used, for example.

Water or a dispersing medium having water as a main component, a styrene-based monomer, and an ethylene unsaturated group-containing monomer each in a prescribed amount are charged into, for example, a three-necked separable flask which is provided with a stirrer, a nitrogen-introducing tube, and a reflux condenser. A temperature in the flask is raised to about 70° C. in a current of inert gas such as nitrogen gas in a prescribed stirring condition. A prescribed amount of the polymerization initiator is added, and the emulsion copolymerization by a radical polymerization reaction is started. Then, the reaction system is kept at a temperature of about 70° C., and the emulsion copolymerization is completed in about 24 hours. Thus, a desired emulsion can be obtained.

For adjustment of a pH of the emulsion through polymerization, hydrochloric acid, acetic acid, or another acid or alkali, such as sodium hydroxide, may be added.

Subsequently, the obtained emulsion is dried by a drying method, for example, a freeze-drying method or a spray-dry method, to obtain the resin particles of the present invention.

The obtained resin particles of the invention desirably have a volume mean diameter of 80 nm or more and 300 nm or less and high hardness.

The volume mean diameter of the resin particles means an average particle size (ϕ) measured by the following method.

[Average Particle Size Measuring Method]

A particle size analyzer using laser diffraction scattering is used to measure the particle size of the resin particles in an emulsion diluted with ion-exchange water or pure water, and a average particle size is determined as the average particle size (ϕ). A specific examples of a particle size analyzer is a laser diffraction/scattering type particle size distribution measuring device such as the commercially available HORIBA LA-910. According to the present invention, when the volume mean diameter of the resin fine particles exceeds 300 nm, a spacer effect can be obtained but an excessive amount of the resin fine particles must be added to the toner. Therefore, adverse effects on the electrostatic properties of the toner cannot be avoided because of the electrostatic property of the resin particles themselves, or there is an adverse effect that liberation from the toner surface occurs to contaminate a toner image holder (namely, an electrostatic latent image holding member). Meanwhile, when the resin fine particles have a volume mean diameter of less than 80 nm as noted above, there is a disadvantage that it becomes difficult to maintain high transferability over a long period of use.

More specifically, although the developing and transfer are affected by uniform transportation of the developer, an electric current at the time of transfer, or the like, they are most affected by a balance between the electrostatic attraction and the adhesive force of the toner particles with the charging member or the toner particles with the latent image holding member in a step of separating the toner particles from a restraining force of the carrier for carrying the toner particles and adhering to the target material (latent image holding member or transfer material). While control of balance is complicated, but the step of separating the toner particles from the restraining force of the carrier for carrying the toner particles and adhering to the target material (latent image holding member or transfer material) directly affects the image quality, and improvement of the efficiency of the above step improves the reliability and saves energy by omission of cleaning. Therefore, superior developing and transferability are demanded in this step.

Generally, developing and transfer take place when F electrostatic attraction is larger than F adhesive force. Therefore, to improve the efficiency of the developing and transfer, control may be made to improve the electrostatic attraction or to lower the adhesive force (development and transfer force are enhanced). However, when a transfer electric field is raised by, for example, ion discharge to enhance the developing and transfer force, secondary effects, such as generation of a toner with a large positive electric charge or a toner with an opposite polarity, tend to occur.

In light of the above, lowering of the adhesive force is a more effective method for achieving the desired results.

Adhesive forces include, for example, the Van der Waals force (non-electrostatic adhesive force) and a mirror image force by an electric charge possessed by the toner particles. These forces differ on a level close to one order, and it is interpreted that the adhesive force is mostly defined based on the Van der Waals force. The Van der Waals force F between the spherical particles is generally indicated by the following expression.

$$F=H\cdot r_1\cdot r_2/6(r_1+r_2)\cdot a^2$$

(H: a constant, $r_1$, $r_2$: a radius of contact particles, a: a distance between particles)

In order to reduce the adhesive force, a method in which fine powder having a very small particle radius r compared with the toner particles is intervened between the toner particles and the latent image holding member surface or the charging member surface to provide a distance a between the toner particles and the existing carrier surface or between the toner particles and the charging member surface and to reduce a contact area (the number of contact points) is effective. As a means for stably maintaining the above effect, it was found that the volume mean diameter according to the present invention is preferably 80 to 300 nm as described above, and that it is effective to use monodisperse resin particles having high hardness, as described further below.

The resin particles used in the present invention are monodisperse, spherical, and very hard, and therefore uniformly disperse on the toner surface to provide a stable spacer effect. The monodisperse can be defined based on a standard deviation of the average particle size including an aggregate, and the standard deviation is desirably D50×0.20 or less. When concept of "spherical" as used herein can be defined based on Wadell sphericity, sphericity is 0.6 or more, and more preferably 0.8 or more.

When the particle size distribution is large and its standard deviation exceeds D50×0.20, the spacer effect may not be sufficiently obtained unless the amount of added resin particles is increased. However, when the an excessive amount of resin particles is added, an adverse effect on the electrostatic properties of the toner cannot be prevented because of the electrostatic properties of the resin particles themselves as described above, or there is an adverse effect that the toner image holder (i.e., an electrostatic latent image holding member) is contaminated because of liberation of the resin particles from the toner surface.

Hardness of the resin particles is generally correlates with the degree of cross-linking and can be indicated by, for example, a level of gel ratio which indicates the degree of cross-linking. The gel ratio is measured by the following method.

[Gel Ratio Measuring Method]

Dry resin fine particles are weighed to prepare an approximately 0.3 g sample. This sample is charged into 30 g of an organic solvent and stirred for 60 minutes. Then, centrifugal separation is performed at a rotation speed of 10,000 rpm for five minutes, and a supernatant fluid containing a dissolved substance extracted from the organic solvent is removed. After substances not dissolved in the organic solvent are dried using a vacuum dryer, the weight of the resulting sample is measured, and a gel ratio (% by weight) is calculated using the following expression. The organic solvent may be any type of organic solvent which can dissolve a polymer consisting of the styrene-based monomer, and its example may be tetrahydrofuran or the like.

Gel ratio (% by weight)=(Weight of resin particles undissolved in organic solvent/Weight of resin particles used as sample)×100

To obtain the hardness required for the present invention, the gel ratio of the resin particles is required to be 60% by weight or more, and more preferably 80% by weight or more. When a toner, to which the resin particles having the gel ratio of less than 60% by weight are added, and a carrier are mixed at a prescribed ratio to prepare a developer and the developer is set in a developing unit of a copy machine and used repeatedly, the spacer effect produced by the resin particles initially provides superior developing and transferability characteristics. However, the resin particles are gradually deformed from the spherical shape to a flat shape over time due to the stress applied to the toner within the developing unit. Thus, the adequate spacer effect is lost, and developing and transferability are degraded as a result.

The resin particles used for the invention have high hardness, but the hardness is lower than that of inorganic particles of silica or the like because of the material of the resin particles. In cleaning after the transfer to be described below, the blade, electrostatic brush, or charging roller which is used in a contact type charger do not cause defects because abrasive silica is not present. A stable image can therefore be maintained for a long period when the resin particles are used.

The charge amount of the monodisperse resin particles employed in the present invention must have the same polarity as the toner with respect to the carrier. If the toner has a negative electrostatic property and the resin particles have a positive electrostatic property, there is a disadvantage that, when the resin particles are added to the toner, its charge amount becomes very low. If this resin particle-added toner having the above configuration is stirred with the carrier for a long period and an additional toner is added, an opposite polarity toner tends to be produced. This is presumably caused because the resin particles which must be on the toner surface are somewhat buried in a toner bulk because of the long-term stirring to change the toner surface structure, and the toner and the resin particles have different charged polarities.

The charged polarity of the resin particles of the invention can be controlled by adjusting the pH of the emulsion through emulsion copolymerization, as can be measured by a powder charge amount measuring apparatus, such as commercially available TB-200 apparatus manufactured by Toshiba Chemical Corporation, after mixing with prescribed ferrite powder and charging. The charged polarity of the toner to be described later can also be measured in the same manner.

[Inorganic Compound]

To obtain an additional spacer effect, in the toner according to the present invention can be included an inorganic compound in addition to the above-described monodisperse resin particles having high hardness. It is necessary to fully coat the toner surface so to control the toner flowability and charging. When sufficient coating may not be obtained by the resin particles of the prevent invention alone, an inorganic compound having a diameter smaller than that of the resin particles can be used simultaneously. The inorganic compound having a small diameter may be, for example, an organic compound having a volume mean diameter of 80 nm or less, and preferably 50 nm or less.

For the inorganic compound having a small diameter used for the toner of the invention, a known one can be used. For example, silica, alumina, titania, calcium carbonate, magnesium carbonate, calcium phosphate, cerium oxide, and the like can be used. The surface of the inorganic fine particles may be treated by a known method according to intended use.

[Electrostatic Latent Image Developing Dry Toner]

The electrostatic latent image developing dry toner may comprise a binder resin, a colorant, and a releasing agent, as necessary, and a toner having a volume mean diameter of 2 to 8 $\mu$m can be used.

An image with high developability, transferability, and image quality can be obtained by using a toner having a shape factor (SF1) of 100 to 140. The shape index is calculated by $SF1=(\text{maximum diameter})^2\times\pi\times100/(\text{area}\times4)$, and becomes SF1=100 when the toner particles are perfectly spherical. Specifically, the toner particles becomes closer to complete spheres as the above value becomes closer to 100, and the toner particles become flat as the above value becomes larger than 100, resulting in a so-called indefinite shape. Here, ML indicates an absolute maximum length of the toner particles, and A indicates a projected area of the toner particles.

It was found that when the toner is spherical or near spherical and the monodisperse resin particles of the invention are added, an effect of additionally lowering the adhesive force of the toner in the above-described development and transfer is enhanced. It is presumed that when the toner is indefinite in shape and has an uneven surface, the spacer effect is reduced, even if monodisperse resin particles are added to the toner surface because the monodisperse resin particles enter the recessed portions, and the monodisperse resin particles do not serve as spacers in the recessed portions of the toner because they are not present on the protruded portions of the toner. Meanwhile, when the toner is spherical or close to spherical, the above-described phenomenon is suppressed, and the monodisperse resin particles can fully exhibit the spacer effect. Thus, the toner adhesive force is lowered during developing and transfer, and the image quality can be improved.

The production method of the toner used for the present invention is not particularly as long as the resulting toner satisfies the above-described shape index and particle size. Any appropriate known method can be used therefor.

Examples of the method for production of the toner include a kneading and pulverizing method which kneads, pulverizes, and classifies a binder resin, a colorant, a releasing agent, and a charge controlling agent as required; a method which changes the shape of the particles obtained by the kneading and pulverizing method by a mechanical impulse force or heat energy; an emulsion polymerization aggregation method which emulsion-polymerizes a polymerizable monomer of a binder resin, mixes the prepared dispersion liquid, a colorant, a releasing agent, and a dispersion liquid such as a charge controlling agent as required to cause aggregation and heat fusion so to obtain toner particles; a suspension polymerization method which performs suspension polymerization of a polymerizable monomer for obtaining a binder resin, a colorant, a releasing agent and a charge controlling agent in a water-based solvent as necessary; and a solving and suspension method which suspends a solution of a binder resin, a colorant, a releasing agent, and a charge controlling agent as necessary in a water-based solvent to produce particles. A production method, which uses the toner produced by the above-described method as a core, adheres aggregation particles and conducts heating and fusing to provide a core shell structure, may be performed.

Examples of the binder resin can be a homopolymer and a copolymer of styrenes such as styrene and chlorostyrene; monoolefins such as ethylene, propylene, butylenes and isoprene; vinylesters such as vinyl acetate, vinyl propionate, vinyl benzoate and vinyl butyrate; $\alpha$-methylene aliphatic monocarboxylates such as methyl acrylate, ethyl acrylate, butyl acryliate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Particularly typical binder resins can be polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene and polypropylene. There are also polyester, polyurethane, epoxy resin, silicone resin, polyamide, modified rosin and paraffin wax.

Examples of typical colorants for the toner are magnetite, ferrite and other magnetic powder, carbon black, aniline blue, charcoal blue, chrome yellow, ultramarine blue, Dupont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1 and C.I. pigment blue 15:3.

Examples of typical releasing agents include low molecular weight polyethylene, low molecular weight polypropylene, Fischer-Tropsch wax, montan wax, carnauba wax, rice wax, candelilla wax, and the like.

A charge controlling agent may be added to the electrostatic latent image developing dry toner of the present invention as required. The charge controlling agent can be any known agent, such as, for example, an azo-based metal complex compound, a metal complex compound of salicylic acid, and a resin type charge controlling agent containing a polar group. It is, however, desirable to use a material resistant to melting into water when the toner is produced by a wet production method in terms of control of ionic strength and reduction of contamination by waste water. The toner of the invention may also be either the magnetic toner containing a magnetic material or the non-magnetic toner not containing a magnetic material.

An electrostatic latent image dry toner as described above, and in which the resin particles and the electrostatic latent image developing toner have the same charged polarity in terms of a charging member or a carrier.

[Toner Production Method]

The toner of the present invention is produced by adding monodisperse resin particles having a volume mean diameter of 80 to 300 nm and high hardness and an inorganic compound as required to the above-described electrostatic latent image developing dry toner particles and mixing them. For the production of the toner by adding the inorganic compound, a variety of methods for addition of the inorganic compound were studied and it was found that a high degree of effectiveness of the present invention could be obtained by first mixing the monodisperse resin particles having a particle size of 80 to 300 nm and high hardness with the toner particles and adding an inorganic compound having a small size with a shear smaller than that of the above-described resin particles. When the monodisperse resin particles and the inorganic compound having a small size are added together for mixing with the toner particles, the inorganic compound having a small size adheres selectively to the surface of the toner particles, which is not preferable because liberation of the resin particles having a large size increases. Also, when the inorganic compound having a small particle size is first added for mixing with the toner particles, the toner's flowability becomes so high that a shear is not applied at the second mixing stage, and it becomes difficult to uniformly disperse the external additive such as resin particles on the surface of the toner particles. This phenomenon becomes especially conspicuous when a spherical toner is used.

To mix the above-described toner particles and resin particles, and an inorganic compound as necessary, a known mixer, such as a V-type blender, a Henschel mixer or a Loedige mixer, can be used.

A variety of additives may be added as necessary at the time of the above-described mixing. Such additives include another fluidizing agent, polystyrene fine particles, polymethyl methacrylate fine particles, polyvinylidene fluoride fine particles, and other cleaning auxiliary agents or transfer auxiliary agents.

An added amount of the monodisperse resin particles having a volume mean diameter of 80 to 300 nm and high hardness is 0.5 to 5 parts by weight, and more preferably 1 to 3 parts by weight, of resin particles to 100 parts by weight of a toner. When the added amount of the resin particles is less than 0.5 part by weight, transferability of the toner is reduced. Meanwhile, when the amount of added resin particles exceeds 5 parts by weight, an adverse effect on the electrostatic properties of the toner cannot be avoided because of the electrostatic property of the resin particles themselves, or there is an adverse effect of contaminating a toner image holder (i.e. the electrostatic latent image holding member) because of liberation from the surface of the toner.

In the present invention, an adhered state of a hydrophobized compound or an inorganic compound to the surface of the toner particles may be simple mechanical adhesion or loose fixing to the surface, and the toner particles may be entirely or partly coated. Further, the added amount of the hydrophobized compound or the inorganic compound toner may be 0.3 to 3 parts by weight, or more preferably 0.5 to 2 parts by weight, to 100 parts by weight of the toner.

A screening process may be conducted after mixing the additive.

[Carrier]

The carrier employed in conjunction with the present invention is a resin-coated carrier having a resin-coated layer, which has a conductive material dispersed in a matrix resin, on a core material.

The above carrier is a type of charging member.

When the above-described spherical toner is used, a packing property is naturally improved at a transport restriction part in the developing unit. Accordingly, a strong force is applied to not only the toner surface but also the carrier. Therefore, it was found that when the conductive material was dispersed for containment into the resin-coated layer of the carrier, a high quality image could be shown for a long period without largely changing the volume specific resistance of the carrier, even if the resin-coated layer of the carrier was peeled by application of a strong force.

Examples of the matrix resin include polyethylene, polypropylene, polystyrene, polyacrylonitrile, polyvinyl acetate, polyvinyl alcohol, polyvinyl butyral, polyvinyl chloride, polyvinylcarbazole, polyvinyl ether, polyvinyl ketone, vinyl chloride-vinyl acetate copolymer, styrene-acrylic acid copolymer, straight silicone resin of organosiloxane bonding or its modified product, fluorocarbon resin, polyester, polyurethane, polycarbonate, phenol resin, amino resin, melamine resin, benzoguanamine resin, urea resin, amide resin, epoxy resin, and others, but the matrix resin is not limited to them.

Examples of the conductive material include gold, silver, copper, and other metals, as well as titanium oxide, zinc oxide, barium sulfate, aluminum borate, potassium titanate, tin oxide, carbon black, etc., but the conductive material is not limited to them.

A content of the conductive material is preferably 1 to 50 parts by weight, and more preferably 3 to 20 parts by weight, to 100 parts by weight of the matrix resin.

As a core material of the carrier, magnetic metals such as iron, nickel, and cobalt, magnetic oxides such as ferrite and magnetite, and glass beads may be employed. A magnetic material is preferably used for adjustment of volume specific resistance by a magnetic brush method.

The core material generally has an average particle size of 10 to 150 $\mu$m, and preferably 30 to 100 $\mu$m.

Methods of forming the resin-coated layer on the surface of the core material of the carrier include a dip method in which the carrier core material is dipped into a coated layer-forming solution containing a matrix resin, a conductive material, and a solvent; a spray method in which the surface of a carrier core material is sprayed with a coated layer-forming solution; a fluidized-bed method in which a coated layer-forming solution is sprayed while the carrier core material is maintained in a state floated by flowing air; and a kneader coater method in which the carrier core material and a coated layer-forming solution are mixed in a kneader coater and a solvent is removed.

The solvent used in the coated layer-forming solution is not particularly limited, as long as the solvent can dissolve the matrix resin. For example, aromatic hydrocarbons such as toluene and xylene, ketones such as acetone and methyl ethyl ketone, and ethers such as tetrahydrofuran and dioxane can be used.

The resin-coated layer generally has an average thickness of 0.1 to 10 $\mu$m, but the thickness is preferably in a range of 0.5 to 3 $\mu$m in order to ensure stable volume specific resistance of the carrier over a long period.

The volume specific resistance of the carrier formed as described above is preferably $10^6$ to $10^{14}$ Ωcm in a range of $10^3$ to $10^4$ V/cm which corresponds to the upper and lower limits of an ordinary development contrast potential in order to achieve the high image quality. When the carrier has volume specific resistance of less than $10^6$ Ωcm, reproducibility of thin lines becomes poor, and applied electric charges tend to cause background toner fogging. When the carrier has a volume specific resistance of more than $10^{14}$ Ωcm, reproduction of a solid black area and a halftone becomes inferior. An amount of the carrier shifting to the photoreceptor increases, and the photoreceptor tends to be damaged. The electrostatic brush can be a resin containing a conductive filler such as carbon black or metal oxide or a fibrous substance having its surface coated with such a resin but not limited to them.

[Developer]

The developer of the invention is an electrostatic latent image developer consisting of the above-described toner and carrier.

[Image Forming Method]

One example of use of the image-forming device used in conjunction with the image-forming method of the present invention will be described below.

Image Forming Device

In the image-forming method of the invention, the image-forming device used for forming an image is comprised of a latent image holding member, charging means for charging the surface of the latent image holding member, latent image-forming means for forming a latent image on the surface of the charged latent image holding member, developing means for developing the electrostatic latent image with a toner, and transfer means for transferring the toner image formed by developing onto a transfer material. Especially, an image-forming device comprising a plurality of latent image holding members, charging means for charging the surface of the latent image holding members, latent image-forming means for forming latent images on the surface of the charged latent image holding members, developing means for developing the electrostatic latent images with a toner, and transfer means for transferring the toner images formed by developing onto a transfer material are employed. In other words, a tandem type image-forming device is preferably used.

Especially, when a full color image is produced by the image-forming method of the invention, it is preferable in view of versatility of paper and high image quality that color toner images having respective colors are transferred and superposed onto the surface of an intermediate transfer belt or intermediate transfer drum as the transfer material and the superposed color toner images are collectively transferred onto the surface of a recording medium such as paper.

An example of the image-forming device used in the present invention will be described below.

FIG. 1 is a schematic sectional view showing an example of the image-forming device used in the present invention. As shown in FIG. 1, this image-forming device has four development units 40Y, 40M, 40C, 40K, respectively forming yellow, magenta, cyan, and black color images, disposed in parallel (in tandem) at prescribed intervals. The individual developing units 40Y, 40M, 40C, 40K are basically configured in the same manner with the exception of the toner colors of the accommodated developer. Therefore, the developing unit 40Y for yellow will be described as a typical unit.

The developing unit 40Y for yellow is provided with a photosensitive drum (latent image holding member) 1Y as an image carrier. This photosensitive drum 1Y has an axis in a direction perpendicular to the sheet on which FIG. 1 is drawn and is driven to rotate at a prescribed process speed by drive means (not shown) in direction A shown in the drawing. For the photosensitive drum 1Y, an organic photoreceptor having sensitivity in an infrared area is used.

The process speed may be changed automatically or manually under prescribed conditions. The image-forming method of the invention can form a high quality image and retain the developer, even when the device is one which can change process speed during operation. Here, "the automatic under prescribed conditions" includes, for example, a case that when image information containing a high definition image such as a photo image is input, a normal mode is automatically changed to a low-speed mode so to obtain a high quality image.

A roll charging type charger (charging means) 20Y is disposed on the upper part of the photosensitive drum 1Y of FIG. 1, a prescribed voltage is applied to the charger 20Y from a power supply which is not shown, and the surface of the photosensitive drum 1Y is charged to a prescribed potential. The same process is also applied to chargers 20M, 20C, 20K, and photosensitive drums 1M, 1C, 1K.

A latent image-forming means 3Y for forming an electrostatic latent image by exposing an image on the surface of the photosensitive drum 1Y is disposed around the photosensitive drum 1Y downstream of the charger 20Y in the rotation direction of the photosensitive drum 1Y. As the latent image-forming means 3Y, an LED array which can be made compact is used because the space is limited, but it is not essential and other latent image-forming means using a laser beam can be used.

A yellow color developing unit 4Y is also disposed around the photosensitive drum 1Y downstream of the latent image-forming means 3Y in the rotation direction of the photosensitive drum 1Y. An electrostatic latent image formed on the surface of the photosensitive drum 1Y is visualized with a yellow color toner to form a toner image on the surface of the photosensitive drum 1Y.

Below the photosensitive drum 1Y shown in FIG. 1 is disposed an intermediate transfer belt 15 for primary transfer of the toner image formed on the surface of the photosensitive drum 1Y to extend below the four photosensitive drums 1Y, 1M, 1C, 1K. This intermediate transfer belt 15 is propelled toward the surface of the photosensitive drum 1Y by the primary transfer roller 5Y. The intermediate transfer belt 15 is held under tension by drive means comprising three rollers, which are a drive roller 11, a support roller 12 and a backup roller 13, and is driven to rotate in a direction of arrow B at a moving speed equal to a process speed of the photosensitive drum 1Y. Toner images of magenta, cyan, and black colors sequentially undergo primary transfer and superposition to the yellow toner image on the surface of the intermediate transfer belt 15.

Cleaning means 6Y comprising a cleaning blade for cleaning the toner remaining on the surface of the photosensitive drum 1Y or the transferred toner is disposed around the photosensitive drum 1Y downstream of the primary transfer roller 5Y in the rotation direction (a direction of the arrow A) of the photosensitive drum 1Y. The cleaning blade of the cleaning means 6Y is attached in a counter direction to come into contact with the surface of the photosensitive drum 1Y.

A secondary transfer roller 14 is pressed into contact with the backup roller 13 for tensing the intermediate transfer belt 15 with the intermediate transfer belt 15 between them. The toner image which underwent primary transfer and has been superposed on the surface of the intermediate transfer belt 15 is electrostatically transferred onto the surface of a transfer material 16 which is fed from a sheet cassette (not shown) to a nip portion of the backup roller 13 and the secondary transfer roller 14.

A cleaning member 17 for the intermediate transfer belt is disposed on the outer periphery of the intermediate transfer belt 15 at a position substantially corresponding to the surface of the drive roller 11 so as to come into contact with the surface of the intermediate transfer belt 15.

A fixing device 18 is disposed below the drive roller 11 for the intermediate transfer belt 15 shown in FIG. 1 to transfer the toner images, which are multiple-transferred onto the transfer material 16, onto the surface of the transfer material 16 by heating and pressing to provide a permanent image.

Next, the operations of the developing units 40Y, 40M, 40C, 40K, which form the respective yellow, magenta, cyan and black color images, configured as described above will be described. The operation of the yellow developing unit 40Y will be described as an illustrative example because the developing units 40Y, 40M, 40C, 40K all operate in the same manner.

The photosensitive drum 1Y of the yellow developing unit 40Y rotates at a prescribed process speed in the direction of arrow A, and the surface of the photosensitive drum 1Y is negatively charged to a prescribed electric potential by an electric discharge produced in the fine gap between the charger 20Y and the photosensitive drum 1Y by applying a prescribed voltage to the charger 20Y by a power supply which is not shown, or by imparting an electric charge. Then, the image is exposed on the surface of the photosensitive drum 1Y by the latent image-forming means 3Y to form an electrostatic latent image according to the image information. The electrostatic latent image formed on the photosensitive drum 1Y is visualized on the surface of the photosensitive drum 1Y to form a toner image as the toner negatively charged by the developing unit 4Y is reverse-developed. The toner image formed on the surface of the photosensitive drum 1Y is first transferred onto the surface of the intermediate transfer belt 15 by the primary transfer roller 5Y. After the primary transfer, the toner and the like remaining on the surface of the photosensitive drum 1Y is scraped off by the cleaning blade of the cleaning means 6Y in preparation for the next image formation step.

The above operation is performed by each of the developing units 40Y, 40M, 40C, 40K, and the toner images visualized on the surfaces of the respective photosensitive drums 1Y, 1M, 1C, 1K are successively multiple-transferred onto the surface of the intermediate transfer belt 15. In a full-color mode, the respective color toner images are sequentially transferred in order of yellow, magenta, cyan, and black, and a toner image having a required color is transferred in the same order solely or in combination for unicolor, bicolor, and tricolor modes. Then, the toner image transferred to the surface of the intermediate transfer belt 15 after one or more primary transfers is secondarily transferred by the secondary transfer roller 14 onto the surface of the transfer material 16 conveyed from a sheet cassette which is not shown, then heated and pressed for fixing by the fixing device 18. After the secondary transfer, the toner remaining on the surface of the intermediate transfer belt 15 is removed by the cleaning member 17 which is a cleaning blade for the intermediate transfer belt 15.

In the image-forming device used for the image-forming method of the present invention, the respective component members specified in the invention are not further limited. Therefore, the component elements such as the latent image holding member, the intermediate transfer belt (or the intermediate transfer drum), and the charger can be any known component elements.

The charging means, however, is preferably a roller charging type charger because reducing the generation of ozone can greatly benefit environmental conservation.

Generally, a blade cleaning method as adopted in the above example is preferably used as the cleaning means 6Y because it provides superior performance stability. To make it possible to clean the toner having a nearly spherical shape, it is desired to optimize the physical characteristic control and contact conditions of the blade. In addition, by using the developer specified by the invention and especially a developer containing a toner to which an external additive combining the above-described monodisperse resin particles and the inorganic compound having a diameter smaller than the monodisperse resin particles is added, it becomes possible to stably clean the toner remaining on the surface of the latent image holding member, and the service life can be largely extended due to the superior wear resistance of the latent image holding member.

The cleaning means may be an electrostatic brush that does not rub the latent image holding member using a blade. The blade cleaning method is generally used because it has highly stable performance, but the toner remaining on the latent image holding member can be recovered using an electrostatic brush when the toner of the invention is used, and it becomes possible to largely extend the wear-out life of the latent image holding member.

The electrostatic brush can be a fibrous material formed of a resin containing carbon black, metal oxide, or another conductive filler or a fibrous material having the conductive filler coated on the surface, but is not limited to these examples.

The cleaning means may also recover the toner remaining on the latent image holding member by the developing device without rubbing the latent image holding member with a blade.

Thus, the stable developing, transfer, and fixing performance can be accomplished without disproportional accumulation of a particular toner, even when the residual toner is recovered into the developing unit.

The image-forming method of the invention was described with reference to the drawing illustrating an example of the image-forming device used for the image-forming method of the invention. It is to be understood that any desired components of the invention may be changed or modified by conventional knowledge as long as the structure of the invention is satisfied, and the invention is not limited to the descried examples.

The invention relates to a color image-forming method for forming an image using an image-forming device which is comprised of charging means for uniformly charging a latent image holding member, latent image-forming means for forming an electrostatic latent image by exposing the charged latent image holding member, developing means for developing the electrostatic latent image with a toner, and transfer fixing means for transferring the toner image formed by developing onto the intermediate transfer material and also fixing the toner image on a recording material at the same time, wherein the toner contains a binder resin, a colorant, a releasing agent if necessary, and resin particles having a volume mean diameter of 80 to 300 nm, a gel ratio of 60% or greater by weight and a standard deviation of D50×0.20 or less, and the transfer fixing means develop the respective toners to the respective latent image holding members, transfer onto the intermediate transfer material, then transfer and fix the respective colors onto the recording material at the same time.

In other words, when the image-forming device having the above-described transfer fixing means is used to form an image with the toner of the present invention described above, a high quality full-color image can be obtained.

In the image-forming method of the invention, the intermediate transfer material in the transfer step holding the unfixed toner image is moved to a prescribed toner image fixing position. Specifically, it is desirable to use a two-layered structure formed of a base layer and a surface layer. The base layer can be a resin film containing carbon black, metal oxide, or another conductive filler in order to control a resistance to a low level. The surface layer is preferably a film formed of a material having low surface energy in order to improve releasability of the toner. Such a material is important to be a heat-resistant film, and a film based on PFA (tetrafluoroethylene/perfluoroalkyl vinyl ether copolymer), PTFE (polytetrafluoroethylene), polyimide, or silicone can be used, although the materials are not limited to these.

In the image-forming method of the present invention, the transfer fixing is performed by at least heating by the transfer fixing means, but is preferably performed by heating and pressing. Specifically, it is preferable that, for example, a prescribed recording medium is overlaid on the intermediate transfer material so as to hold the toner image on the intermediate transfer material, and a pair of heating and pressing members which heat and press the overlaid intermediate transfer material, the toner image and the recording medium between them are used. As the heating and pressing members, a roller having a heat-resistant elastic layer of a silicone rubber or the like formed on a metallic roller of iron, stainless steel, copper, aluminum, or the like and containing a heat source such as a halogen lamp can be used. The heating and pressing members are not limited to rollers and can have any structure if a pressure can be applied uniformly without causing lifting or displacement between the intermediate transfer material and the recording medium. For example, they heating and pressing member may be configured of a combination of a single heating and pressing roller and a single fixing pad or a pair of stationary pads.

The above-described inorganic compound is determined to be a hydrophobized compound having an electric resistance of $10^{10}$ Ωcm or more, and respective color toners having the inorganic compound and the above-described high hardness monodisperse resin particles treated onto the surface of the color toner are developed on the latent image holding member and transferred onto the intermediate transfer material. The respective colors can therefore be collectively transferred and fixed to the recording material at the same time to obtain a high quality image. There is also obtained an effect that a PE value which is an index of permeability when a color image is formed on an OHP is not affected.

In addition, the intermediate transfer belt and the transfer drum are used in view of versatility of paper and high image quality to form a full-color image. When the above-described highly hard monodisperse resin particles and the hydrophobized compound having electric resistance of $10^{10}$ Ωcm or more are treated onto the surface of the color toner, high transferability can be obtained without producing an opposite polarity toner even when a transfer electric field is increased. Initial transferability can be naturally obtained, and the same high transferability as the initial one can be obtained regardless of stress over time.

An image-forming method as described above, wherein the toner consists of a plurality of toners each containing a plurality of colorants, the transfer means temporarily transfer to superpose the respective color toner images, which are formed by developing with the plurality of toners, onto a transfer material (e.g., an intermediate transfer belt or an intermediate drum), and transfers the superposed color toner images onto the surface of a recording medium at one time.

An image-forming method as described above, wherein the image-forming device comprises cleaning means for removing toner remaining on the latent image holding member after the transfer, the toner contains a binder resin, a colorant and resin particles having a volume mean diameter of 80 to 300 nm, a gel ratio of 60% or more by weight, and a standard deviation of D50×0.20 or less, and the cleaning means recover the toner remaining on the latent image holding member using an electrostatic brush, without rubbing the latent image holding member with a blade.

The image-forming method as described above, wherein the image-forming device also has recovering means for recovering toner remaining on the latent image holding member into the developing unit, without rubbing the latent image holding member by the blade.

An image-forming method as described above, wherein the toner contains an inorganic compound having a diameter smaller than the resin particles.

EXAMPLES

The invention will be described more specifically with reference to the following examples. It is to be understood that the invention is not limited to the examples. Below, "parts" as used in the description of the toner and the carrier refers to "parts by weight" unless otherwise specified. In the production of toners, carriers, and electrostatic latent image developers, respective measurements are made by the following methods.

Measurement of Charged Polarity of Resin Particles (1) 100 parts of ferrite powder (EFC50B manufactured by Powder-Tech Co.) and 1 part resin particles is charged into a glass bottle having an internal volume of 250 cc.
(2) The bottle is left standing in an environment of a temperature of 25° C. and a humidity of 55% RH for three hours or more (seasoning).
(3) In the same atmosphere, the glass bottle is covered with a lid, set on a TURBULA shaker-mixer (manufactured by Willy A. Bachofen AG), and stirred at 90 rpm for one minute.
(4) 0.5 g samples of the mixture are collected for measurement using a powder charge amount measuring device (TB-200 manufactured by Toshiba Chemical Corporation) under the following conditions:
   A Faraday cage having a 20 $\mu$ mesh stainless steel net is set in a manner to prevent leaking of ferrite powder.
   Blow pressure of the device: 10 kPa in digital indication value
   Suction force of the device: −5 kPa
   Blow time of the device: 20 seconds

Measurement of Charge Amount and Polarity of Toner

Charged polarity of the toner is measured in the same manner as in the above-described <Measurement of charged polarity of resin particles> except that "one part of resin particles" of (1) above is changed to "8 parts of the toner".

Measurement of Primary Particle Size of External Additive and its Standard Deviation A laser diffraction and scattering type grain size distribution measuring device (HORIBA LA-910) is used.

Sphericity

For sphericity, Wadell's actual sphericity is adopted.

Sphericity=Surface area of spheres having the same volume as the actual particles (a)/Surface area of actual particles (b)

Notes: (a) Calculated from the average particle size.
(b) Substitute for BET specific area with a Shimazu powder specific surface measuring device SS-100 used.

Measurement of Resistance

Figure 2:
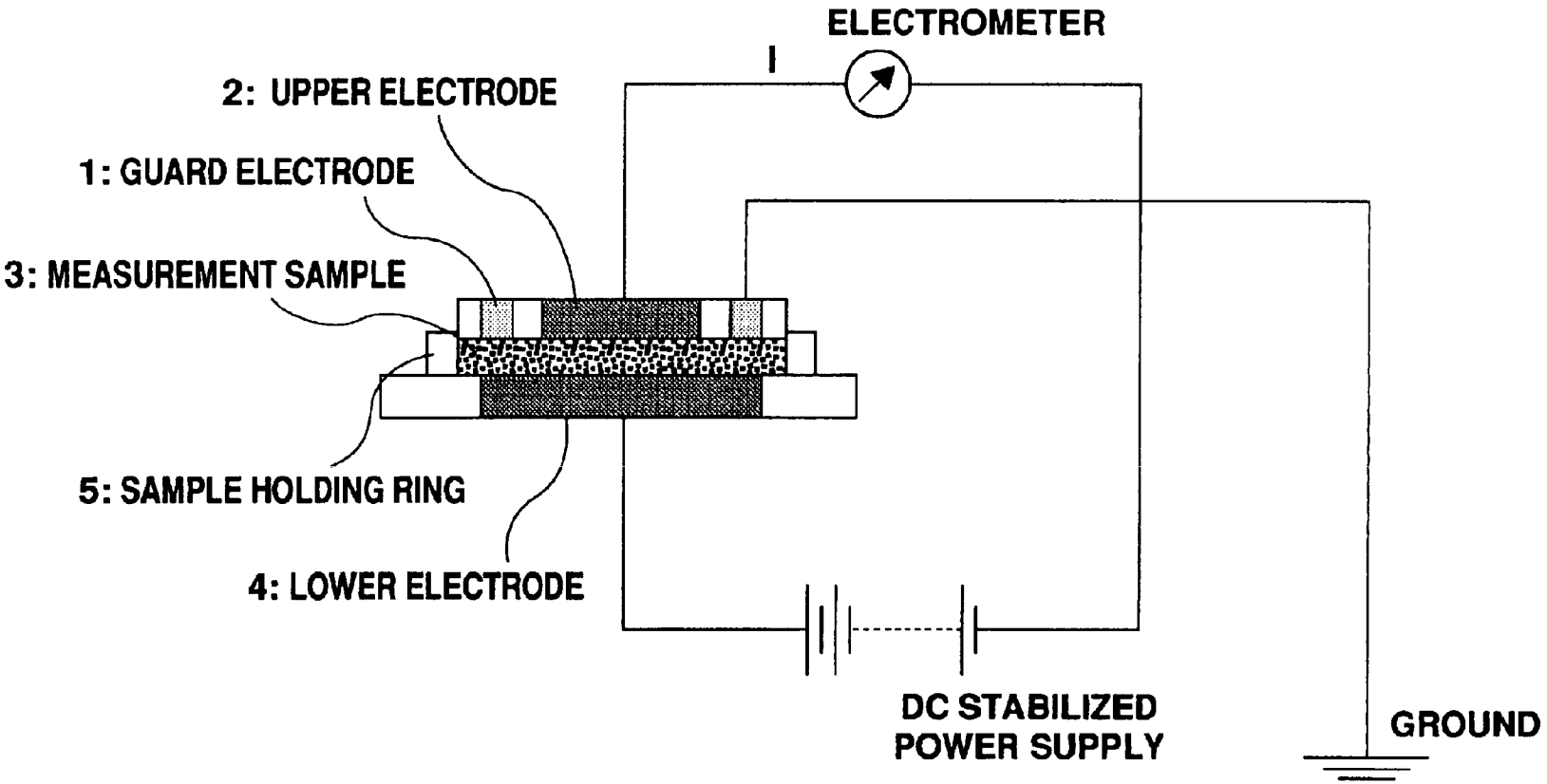
FIG. 2 is a diagram showing an example of the resistance measuring device of the present invention.

As shown in FIG. 2, a measurement sample 3 having thickness H is held between a lower electrode 4 and an upper electrode 2. A thickness is measured by a dial gauge while pressuring from the above, and electric resistance of the measurement sample 3 is measured. Specifically, the measurement sample is charged on the lower electrode 4 (the electrode portion of 80ϕ) of 100ϕ, a charged height is leveled at 1 mm, the upper electrode 2 (the electrode portion 50ϕ) is placed in position, and a load of 3.43 kg is applied to the upper electrode 2. And, a thickness is measured by a dial gauge. Then, a voltage is applied, a current value is read, and a volume specific resistance is determined by calculation.

Average Shape Index of Toner

In the invention, the shape factor (SF1) of the toner is a value calculated by the following expression and becomes 100 when the toner is a perfect sphere.

$$SF1=(\text{maximum length})^2\times\pi\times100/(\text{area}\times4)$$

As a specific method for determining the shape factor, a toner image is captured from an optical microscope into an image analyzing device (LUZEXIII manufactured by Nireco Corporation) to measure a circle-corresponding diameter, and the SF1 value of the above expression is determined for each particle from the maximum length and area.

Measurement of Charge Amount of Toner

For the charge amount at a high temperature and high humidity and a low temperature and low humidity, both the toner and the carrier are left standing in respective atmospheres of a high temperature and high humidity of 30° C. and 90% RH and a low temperature and low humidity of 5° C. and 10% RH for 24 hours. Then, the toner and the carrier are collected into a lidded glass bottle so to be TC 5% and stirred by a TURBULA shaker-mixer in respective atmospheres. The stirred developer is measured by TB200 of Toshiba Corporation under conditions of 25° C. and 55% RH. The device conditions are the same as for the measurement of charged polarity of resin particles described above.

A charge amount in the actual device evaluation test is measured by the TB200 of Toshiba Corporation under the same conditions of 25° C. and 5% RH as above by collecting the developer on a magnet sleeve in the developing unit. The device conditions are the same as for the measurement of charged polarity of resin particles described above.

Image Density (Solid Area Density)

Image density is measured using an X-Rite 404A (X-Rite).

(Resin Particles)

(A) Preparation of Resin Particles A

Into a three-necked separable flask provided with a stirrer, a nitrogen-introducing tube, and a reflux condenser and having an internal volume of 2000 mL, 100 parts of ion-exchange water, 100 parts of styrene, 50 parts of trimetylolpropanetri(meta)acrylate, and 0.1 part of a reactive surfactant (product name "HS-10" manufactured by Dai-ichi Kogyo Seiyaku Co., Ltd.) are charged. The temperature is raised to 70° C. in a current of nitrogen gas under a prescribed stirring state, and 0.7 part of ammonium persulfate is added as a polymerization initiator after a lapse of 30 minutes to start emulsion polymerization by a radical polymerization reaction. Then, the temperature of the reaction system is maintained at 70° C., and the emulsion polymerization is completed in about 24 hours to prepare an emulsion. Then, a diluted solution of 1% sodium hydroxide is dripped to adjust a pH to 4.0. The prepared emulsion is dried by a freeze dryer for one whole day and night to obtain resin particles A in a white powder state.

(B) Preparation of Resin Particles B

Resin particles B in a white powder state are prepared in the same manner as the resin particles A except that 600 parts of ion-exchange water, 100 parts of styrene, 80 parts of trimetylolpropanetri(meta)acrylate, and 0.5 part of "HS-10" are used for preparation.

(C) Preparation of Resin Particles C

Resin particles C in a white powder state are prepared in the same manner as the resin particles A except that 100 parts of styrene, 40 parts of trimetylolpropanetri(meta) acrylate, and 0.1 part of "HS-10" are used for preparation.

(D) Preparation of Resin Particles D

Resin particles D in a white powder state are prepared in the same manner as the resin particles A except that 800 parts of ion-exchange water, 100 parts of styrene, 0.5 part of trimetylolpropanetri(meta)acrylate, and 0.1 part of "HS-10" are used for preparation.

(E) Preparation of Resin Particles E

Resin particles E in a white powder state are prepared in the same manner as the preparation of the resin particles A except that the temperature of the reaction system is 60° C. for 12 hours in the first half of the emulsion polymerization and 80° C. in the second half.

(F) Preparation of Resin Particles F

Resin particles F in a white powder state are prepared in the same manner as the preparation of the resin particles A except that a diluted solution of 1% sodium hydroxide is dripped to adjust a pH to 9.0.

(G) Preparation of Resin Particles G

Resin particles G in a white powder state are prepared in the same manner as the preparation of the resin particles A except that 500 parts of ion-exchange water are provided.

(H) Preparation of Resin Particles H

Resin particles H in a white powder state are prepared in the same manner as the preparation of the resin particles A except that 2000 parts of ion-exchange water are provided.

The resin particles A to H are measured for an average particle size, standard deviation of particle size distribution, sphericity, a gel ratio, and charged polarity by the above-described measuring methods. The results are shown in Table 1.

TABLE 1

| | Characteristics of resin particles | | | | | | | |
|---|---|---|---|---|---|---|---|---|
| | Average particle dia. (μm) | | Standard deviation of particle size distribution | | | Gel ratio (weight %) | | |
| Resin particles | Measurements | Judgment | Measurements | Judgment | Sphericity | Measurements | Judgment | Charged polarity |
| A | 0.11 | ○ | 0.015 | ○ | 0.85 | 99 | ○ | Negative |
| B | 0.15 | ○ | 0.014 | ○ | 0.80 | 99 | ○ | Negative |
| C | 0.09 | ○ | 0.012 | ○ | 0.90 | 90 | ○ | Negative |
| D | 0.13 | ○ | 0.010 | ○ | 0.70 | 40 | X | Negative |
| E | 0.11 | ○ | 0.025 | X | 0.85 | 99 | ○ | Negative |
| F | 0.11 | ○ | 0.015 | ○ | 0.85 | 99 | ○ | Positive |
| G | 0.20 | ○ | 0.020 | ○ | 0.90 | 99 | ○ | Negative |
| H | 0.70 | X | 0.010 | ○ | 0.90 | 99 | ○ | Negative |

An average particle size in a range of 0.8 to 0.3 μm is judged to be ○, and all other average particle sizes to be X. For the standard deviation of particle size distribution, when the standard deviation<(average particle size)×0.2 is met, it is indicated by ○, and other indicated by X. A gel ratio of 60% or more is indicated by ○, and less than 60% is indicated by X.

The resin particles A to H are tested to check particle hardness. The test details are as follows.

Test Details

Ferrite particles (average particle size of 50 μ manufactured by Powder-Tech Co.) in 100 g and resin particles in 0.1 g are placed in a 250-cc glass sample bottle and stirred by a TURBULA shaker-mixer for ten minutes. The mixture is sampled and observed through an electron microscope.

As a result, among the resin particles A to H, it is found that the resin particles D having a low gel ratio which are originally spherical are flattened, and the resin particles A to C and E to H having a high gel ratio held the spherical shape.

| (Toner) [Production method of color particles A] | |
|---|---|
| Styrene-n-butylacrylate resin: (Tg = 58° C., Mn = 4000, Mw = 24000) | 100 parts |
| Carbon black: (Mogul L manufactured by Cabot Corporation) | 3 parts |

A mixture of the above components is kneaded by an extruder, pulverized by a jet mill, and dispersed by an air classifier to obtain a black toner A having D50=5.0 μm and SF1=139.8. This toner has a charge amount of −35.3 μC/g.

[Production Method of Color Particles B]

| <Preparation of resin dispersion liquid (1)> | |
|---|---|
| Styrene: | 370 parts by weight |
| n-Butyl acrylate: | 30 parts by weight |
| Acrylic acid: | 8 parts by weight |
| Dodecanethiol: | 24 parts by weight |
| Carbon tetrabromide: | 4 parts by weight |

The above components are mixed and dissolved, then dispersed to emulsify in a flask in which a nonionic surfactant (NONIPOL 400 manufactured by Sanyo Chemical Industries, Ltd.) in 6 parts by weight and an anionic surfactant (NEOGEN SC manufactured by Dai-ichi Kogyo Seiyaku Co., Ltd.) in 10 parts by weight are dissolved in an ion-exchange water in 550 parts by weight. Fifty parts by weight of ion-exchange water in which is dissolved 4 parts by weight of ammonium persulfate is charged into the emulsion dispersed product while slowly mixing for ten minutes. The inside of the flask is replaced by nitrogen, the flask is heated in an oil bath while stirring until the content becomes 70° C., and emulsion polymerization is continued for five hours. As a result, there is obtained a resin dispersion liquid (1) in which resin particles having a volume mean diameter of 155 nm, Tg=59° C. and weight average molecular weight of Mw=12000 are dispersed.

| <Preparation of resin dispersion liquid (2)> | |
|---|---|
| Styrene: | 280 parts by weight |
| n-Butyl acrylate: | 120 parts by weight |
| Acrylic acid: | 8 parts by weight |

The above components are mixed and dissolved, then dispersed to emulsify in a flask in which a nonionic surfactant (NONIPOL 400 manufactured by Sanyo Chemical Industries, Ltd.) in 6 parts by weight and an anionic surfactant (NEOGEN SC manufactured by Dai-ichi Kogyo Seiyaku Co., Ltd.) in 12 parts by weight are dissolved into 550 parts by weight of ion-exchange water. While slowly stirring for 10 minutes, 50 parts by weight of ion-exchange water having dissolved therein 3 parts by weight of ammonium persulfate is charged into the emulsion dispersed product. The inside of the flask is replaced by nitrogen, the flask is heated in an oil bath while stirring until the content becomes 70° C., and emulsion polymerization is continued for five hours without changing the condition. As a result, there is obtained a resin dispersion liquid (2) having resin particles with a volume mean diameter of 105 nm, Tg=53° C. and weight average molecular weight of Mw=550000 dispersed.

| <Preparation of colorant dispersion liquid (1)> | |
|---|---|
| Carbon black: (Mogul L manufactured by Cabot Corporation) | 50 parts by weight |
| Nonionic surfactant: (NONIPOL 400 manufactured by Sanyo Chemical Industries, Ltd.) | 5 parts by weight |
| Ion-exchange water: | 200 parts by weight |

The above components are mixed, dissolved and dispersed by a homogenizer (ULTRA-TURRAX T50 manufactured by IKA) for 10 minutes to prepare a color dispersant (1) having colorant (carbon black) particles having an average particle size of 250 nm dispersed.

| <Preparation of colorant dispersion liquid (2)> | |
|---|---|
| Cyan pigment B15:3: | 70 parts by weight |
| Nonionic surfactant: (NONIPOL 400 manufactured by Sanyo Chemical Industries, Ltd.) | 5 parts by weight |
| Ion-exchange water: | 200 parts by weight |

The above components are mixed, dissolved and dispersed by a homogenizer (ULTRA-TURRAX T50 manufactured by IKA) for ten minutes, to prepare a color dispersant (2) having colorant (cyan pigment) particles with an average particle size of 250 nm dispersed.

| <Preparation of colorant dispersion liquid (3)> | |
|---|---|
| Magenta pigment C.I. pigment red 122: | 70 parts by weight |
| Nonionic surfactant: (NONIPOL 400 manufactured by Sanyo Chemical Industries, Ltd.) | 5 parts by weight |
| Ion-exchange water: | 200 parts by weight |

The above components are mixed, dissolved and dispersed by a homogenizer (ULTRA-TURRAX T50 manufactured by IKA) for ten minutes, to prepare a color dispersant (3) having colorant (Magenta pigment) particles with an average particle size of 250 nm dispersed.

| <Preparation of colorant dispersion liquid (4)> | |
|---|---|
| Yellow pigment C.I. pigment yellow 180: | 100 parts by weight |
| Nonionic surfactant: (NONIPOL 400 manufactured by Sanyo Chemical Industries, Ltd.) | 5 parts by weight |
| Ion-exchange water: | 200 parts by weight |

The above components are mixed, dissolved and dispersed by a homogenizer (ULTRA-TURRAX T50 manufactured by IKA) for ten minutes to prepare a color dispersant (4) having colorant (yellow pigment) particles with an average particle size of 250 nm dispersed.

| <Preparation of releasing agent dispersion liquid (1)> | |
|---|---|
| Paraffin wax: (HNP0190 manufactured by Nippon Seiro Co., Ltd., a melting point of 85° C.) | 50 parts by weight |
| Cationic surfactant: (SANISOL B50 manufactured by Kao Corporation) | 5 parts by weight |

The above components are dispersed in a round stainless steel flask for ten minutes using a homogenizer (ULTRA-TURRAX T50 manufactured by IKA), then dispersed by a pressure discharge type homogenizer, to prepare a releasing agent dispersion liquid (1) having releasing agent particles with an average particle size of 550 nm dispersed.

| <Preparation of aggregated particles> | |
|---|---|
| Resin dispersion liquid (1): | 120 parts by weight |
| Resin dispersion liquid (2): | 80 parts by weight |
| Colorant dispersion liquid (1): | 200 parts by weight |
| Releasing agent dispersion liquid (1): | 40 parts by weight |
| Cationic surfactant: (SANISOL B50 manufactured by Kao Corporation) | 1.5 parts by weight |

The above components are mixed in a round stainless steel flask by a homogenizer (ULTRA-TURRAX T50 manufactured by IKA) for dispersion and heated to 50° C. in a heating oil bath while stirring the inside of the flask. Then, the flask is held at 45° C. for 20 minutes, and the content is checked through an optical microscope. It is found that there is formed aggregated particles having an average particle size of approximately 4.0 μm. 60 parts by weight of the resin dispersion liquid (1) is gently added as a resin-containing fine particle dispersion liquid to the above dispersion liquid. Then, a temperature of the heating oil bath is raised to 50° C. and held for 30 minutes. It is found by observing through an optical microscope that there are formed adhered particles having an average particle size of approximately 4.8 μm.

[Preparation of Color Particles B]

Three parts by weight of an anionic surfactant (NEOGEN SC manufactured by DAI-ICHI KOGYO SEIYAKU CO., LTD.) is added to the particle dispersion liquid prepared by the above-described aggregated particle preparation method. The stainless steel flask is sealed and heated to 105° C. by a magnetic seal while stirring and being held for four hours. After cooling, the reaction product is filtered, fully washed with ion-exchange water, and dried to obtain color particles for developing an electrostatic latent image.

The above-described preparation and production methods are used to produce color particles using the respective colorant dispersion liquids (1) to (4).

Formation of Color Particles Kuro B

Kuro toner having SF1=118.5 and standard deviation: particle size D50=5.2 m is obtained using the colorant dispersion liquid (1) by the above-described method. This toner has a charge amount of −65.3 μC/g.

Formation of Color Particles Cyan B

Cyan toner having SF1=119 and standard deviation: particle size of D50=5.4 μm is obtained using the colorant dispersion liquid (2) by the above-described method. This toner has a charge amount of −79.3 μC/g.

Formation of Color Particles Magenta B

Magenta toner having SF1=120.5 and standard deviation: particle size of D50=5.5 μm is obtained using the colorant dispersion liquid (3) by the above-described method. This toner has a charge amount of −67.8 μC/g.

Formation of Color Particles Yellow B

Yellow toner having SF1=120 and standard deviation: particle size of D50=5.3 μm is obtained using the colorant dispersion liquid (4) by the above-described method. This toner has a charge amount of −83.6 μC/g.

| <Formation of carrier> | |
|---|---|
| Ferrite particles (volume average particle size: 50 μm): | 100 parts |
| Toluene: | 14 parts |
| Styrene-methyl methacrylate copolymer (ratio of components: 90/10): | 2 parts |
| Carbon black (R330 manufactured by Cabot Corporation): | 0.2 parts |

First, a carrier is obtained by stirring the above components other than the ferrite particles by a stirrer for 10 minutes to prepare a dispersed coating liquid, placing the coating liquid and ferrite particles into a vacuum deaerate type kneader to stir at 60° C. for 30 minutes, deaerating by decompressing while warming, and drying. The carrier has a volume specific resistance value of $10^{11}$ Ωcm at an applied electric field of 1000 V/cm.

Example 1

Two parts of the resin particles A is added to Kuro, cyan, magenta, and yellow toners each in 100 parts of the color particles B. They are blended by a Henschel mixer at a peripheral speed of 32 m/s for 10 minutes. One part of hydrophobized titanium oxide particles having D50=15 nm and powder resistance of $10^{12}$ Ωcm is added to blend at a peripheral speed of 20 m/s for five minutes, and the mixture is put through a 45 μm mesh sieve to remove large particles so to obtain a toner. A developer is obtained by stirring 100 parts of the carrier and 5 parts of the toner by a V-blender at 40 rpm for 20 minutes and putting through a 177 μm mesh sieve.

Example 2

Two parts of the resin particles B is added to 100 parts of the color particles B Kuro and blended by a Henschel mixer at a peripheral speed of 32 m/s for 10 minutes. One part of hydrophobized titanium oxide particles having D50=15 nm and powder resistance of $10^{11}$ Ωcm is added to blend at a peripheral speed of 20 m/s for five minutes, and the mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Example 3

Three parts of the resin particles C is added to 100 parts of the color particles B Kuro and blended by a Henschel mixer at a peripheral speed of 32 m/s for 10 minutes. One part of hydrophobized titanium oxide particles having D50=15 nm and powder resistance of $10^{12}$ Ωcm is added to blend at a peripheral speed of 20 m/s for five minutes, and the mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Example 4

Three parts of the resin particles A is added to 100 parts of the color particles A Kuro and blended by a Henschel mixer at a peripheral speed of 32 m/s for ten minutes. One part of hydrophobized titanium oxide particles having D50=15 nm and powder resistance of $10^{11}$ Ωcm is added to blend at a peripheral speed of 20 m/s for five minutes, and the mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Example 5

Three parts of the resin particles G is added to 100 parts of the color particles B Kuro and blended by a Henschel mixer at a peripheral speed of 32 m/s for ten minutes. One part of hydrophobized titanium oxide particles having D50=15 nm and powder resistance of $10^{12}$ Ωcm is added to blend at a peripheral speed of 20 m/s for five minutes, and the mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Example 6

Three parts of the resin particles A is added to 100 parts of the color particles B Kuro and blended by a Henschel mixer at a peripheral speed of 32 m/s for ten minutes. One part of hydrophobic silica (RY200 manufactured by Cabot Corporation) having D50=12 nm and powder resistance of $10^{14}$ Ωcm is added to blend at a peripheral speed of 20 m/s for five minutes, and the mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Example 7

Three parts of the resin particles A is added to 100 parts of the color particles B Kuro and blended by a Henschel mixer at a peripheral speed of 32 m/s for ten minutes. One part of hydrophobic silica (TS720 manufactured by Cabot Corporation) having D50=12 nm and powder resistance of $10^{14}$ Ωcm is added to blend at a peripheral speed of 20 m/s for five minutes, and the mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Example 8

Three parts of the resin particles A is added to 100 parts of the color particles B Kuro and blended by a Henschel mixer at a peripheral speed of 32 m/s for ten minutes. One part of hydrophobized titanium oxide particles having D50=15 nm and powder resistance of $10^{12}$ Ωcm and one part of hydrophobic silica (TS720 manufactured by Cabot Corporation) having D50=12 nm and powder resistance of $10^{14}$ Ωcm are added and blended at a peripheral speed of 20 m/s for five minutes, and the mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Example 9

Three parts of the resin particles A and one part of hydrophobized titanium oxide particles having D50=15 nm and powder resistance of $10^{12}$ Ωcm are added to 100 parts of the color particles B Kuro and blended by a Henschel mixer at a peripheral speed of 32 m/s for ten minutes. The mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Comparative Example 1

Three parts of fumed silica RX50 is added to 100 parts of the color particles B Kuro and blended by a Henschel mixer at a peripheral speed of 32 m/s for ten minutes. One part of hydrophobized titanium oxide particles having D50=15 nm and powder resistance of $10^{12}$ Ωcm is added and blended at a peripheral speed of 20 m/s for five minutes. The mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Comparative Example 2

Three parts of the resin particles D is added to 100 parts of the color particles B Kuro and blended by a Henschel mixer at a peripheral speed of 32 m/s for ten minutes. One part of hydrophobized titanium oxide particles having D50=15 nm and powder resistance of $10^{12}$ Ωcm is added and blended at a peripheral speed of 20 m/s for five minutes. The mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Comparative Example 3

Three parts of the resin particles E is added to 100 parts of the color particles B Kuro and blended by a Henschel mixer at a peripheral speed of 32 m/s for ten minutes. One part of hydrophobized titanium oxide particles having D50= 15 nm and powder resistance of $10^{12}$ Ωcm is added and blended at a peripheral speed of 20 m/s for five minutes. The mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Comparative Example 4

Three parts of the resin particles F is added to 100 parts of the color particles B Kuro and blended by a Henschel mixer at a peripheral speed of 32 m/s for ten minutes. One part of hydrophobized titanium oxide particles having D50= 15 nm and powder resistance of $10^{12}$ Ωcm is blended at a peripheral speed of 20 m/s for five minutes. The mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

Comparative Example 5

Three parts of the resin particles H is added to 100 parts of the color particles B Kuro and blended by a Henschel mixer at a peripheral speed of 32 m/s for ten minutes. One part of hydrophobized titanium oxide particles having D50= 15 nm and powder resistance of $10^{12}$ Ωcm is added and blended at a peripheral speed of 20 m/s for five minutes. The mixture is put through a 45 μm mesh sieve to remove large particles so to obtain a toner. A developer is obtained by stirring 100 parts of the carrier and five parts of the toner by a V-blender at 40 rpm for 20 minutes and putting through a 177 μm mesh sieve.

The developers of the above Examples and Comparative Examples are used to evaluate the development and transferability by Docu Color Centre color 400CP manufactured by Fuji Xerox. The results are shown in Table 2 and Table 3.

TABLE 2

Results of evaluation by Docu Color Centre color 400CP (Initial)

| | | Electrostatic property (μC/g) | | Development properties: Solid developing amount (@TC5%:g/m²) | | | | Development properties: Fogging toner (Grade) | | | | Transferability (transfer efficiency % = transfer amount/developing | | | |
|---|---|---|---|---|---|---|---|---|---|---|---|---|---|---|---|
| | | Temp.& humidity = 29° C., 90% | Temp.& humidity = 10° C., 20% | Temp.& humidity = 29° C., 90% | | Temp.& humidity = 10° C., 20% | | Temp.& humidity = 29° C., 90% | | Temp.& humidity = 10° C., 20% | | Temp.& humidity = 29° C., 90% | | Temp.& humidity = 10° C., 20% | |
| Exam. 1 | Kuro | 31 | 40 | 4.6 | ○ | 4.3 | ○ | 75 | ○ | 35 | ○ | 99.3 | ○ | 99.7 | ○ |
| | Cyan | 38 | 42 | 4.3 | ○ | 4.1 | ○ | 60 | ○ | 20 | ○ | 100 | ○ | 100 | ○ |
| | Magenta | 32 | 38 | 4.8 | ○ | 4.0 | ○ | 65 | ○ | 30 | ○ | 99.5 | ○ | 99.3 | ○ |
| | Yellow | 41 | 45 | 4.3 | ○ | 4.1 | ○ | 56 | ○ | 35 | ○ | 99.8 | ○ | 99.9 | ○ |
| Example 2 | | 33 | 40 | 4.6 | ○ | 4.2 | ○ | 75 | ○ | 40 | ○ | 99.5 | ○ | 99.9 | ○ |
| Example 3 | | 34 | 40 | 4.5 | ○ | 4.2 | ○ | 85 | ○ | 60 | ○ | 98.5 | Δ | 99.0 | ○ |
| Example 4 | | 30 | 36 | 4.7 | ○ | 4.2 | ○ | 100 | Δ | 38 | ○ | 92.0 | Δ | 93.8 | Δ |
| Example 5 | | 36 | 44 | 4.3 | ○ | 4.0 | ○ | 65 | ○ | 45 | ○ | 99.1 | ○ | 99.8 | ○ |
| Example 6 | | 40 | 45 | 4.0 | ○ | 4.1 | ○ | 250 | Δ | 95 | ○ | 99.8 | ○ | 99.1 | ○ |
| Example 7 | | 41 | 50 | 3.5 | Δ | 3.5 | Δ | 380 | Δ | 390 | Δ | 98.5 | Δ | 98.5 | Δ |
| Example 8 | | 33 | 45 | 4.6 | ○ | 4.0 | ○ | 125 | Δ | 85 | ○ | 99.5 | ○ | 99.8 | ○ |
| Example 9 | | 30 | 38 | 4.8 | ○ | 4.2 | ○ | 125 | Δ | 55 | ○ | 98.8 | Δ | 98.4 | Δ |
| Comp. Exam. 1 | | 38 | 47 | 4.0 | ○ | 3.7 | Δ | 95 | ○ | 65 | ○ | 85.0 | X | 91.3 | Δ |
| Comp. Exam. 2 | | 30 | 40 | 4.5 | ○ | 4.0 | ○ | 95 | ○ | 20 | ○ | 97.0 | Δ | 98.0 | Δ |
| Comp. Exam. 3 | | 35 | 47 | 4.4 | ○ | 4.2 | ○ | 110 | Δ | 75 | ○ | 95.5 | Δ | 97.0 | Δ |
| Comp. Exam. 4 | | 26 | 33 | 4.9 | ○ | 4.7 | ○ | 260 | Δ | 150 | Δ | 99.5 | ○ | 99.0 | ○ |
| Comp. Exam. 5 | | 35 | 38 | 4.6 | ○ | 4.5 | ○ | 35 | ○ | 20 | ○ | 88.3 | X | 92.0 | Δ |

For evaluation of the development properties, the developer of @TC 5% is left standing overnight at each measured temperature and humidity, an image having a 2 cm×5 cm patch on two points is copied, and a developing amount is measured at hard stop. Two developed portions on a photoreceptor are transferred onto a tape through adhesion. The toner adhered tape is measured for its weight, and the tape weight is subtracted from the measured toner adhered tape weight. Respective toner weights are averaged to determine a developing amount (a target value of 4.0 g/m² to 5.0 g/m²).

For fogging, the background portion is transferred onto the tape in the same manner, and the number of toner particles in one square centimeter is counted. The ○ symbol indicates the number of toner particles is 100 or less, Δ that the number of toner particles is in a range of 100 to 500, and X that the number of toner particles exceeded 500.

For evaluation of transferability, a hard stop is made when the transfer step is completed, a toner weight at two points on the intermediate transfer material is transferred onto the tape in the manner described above, a weight of the toner-adhered tape is measured, and the tape weight is subtracted. Then, the average is determined to obtain a transferred toner amount a, and a toner amount b remaining on the photoreceptor is determined in the same manner. Then, transfer efficiency is determined from the following expression.

$$\text{Transfer efficiency } \eta(\%)=a\times 100/(a+b)$$

$$\eta\geqq 99\% \ldots ○,\ 90\%\leqq\eta<99\% \ldots \Delta,\ \eta<90\% \ldots X$$

TABLE 3

Evaluation results of Docu Color Centre color 400CP (after 10,000 copies)

| | | Electrostatic property (μC/g) | | Development properties: Solid developing amount (g/m²) | | | | Development properties: Fogging toner (Grade) | | | | Transferability (transfer efficiency % = transfer amount/developing | | | |
|---|---|---|---|---|---|---|---|---|---|---|---|---|---|---|---|
| | | Temp. & humidity = 29° C. 90% | Temp. & humidity = 10° C. 20% | Temp. & humidity = 29° C., 90% | | Temp. & humidity = 10° C., 20% | | Temp. & humidity = 29° C., 90% | | Temp. & humidity = 10° C., 20% | | Temp. & humidity = 29° C., 90% | | Temp. & humidity = 10° C., 20% | |
| Exam. 1 | Kuro | 42 | 42 | 4.7 | ○ | 4.2 | ○ | 100 | ○ | 45 | ○ | 99.0 | ○ | 99.3 | ○ |
| | Cyan | 36 | 40 | 4.5 | ○ | 4.3 | ○ | 65 | ○ | 40 | ○ | 99.6 | ○ | 99.5 | ○ |
| | Magenta | 33 | 36 | 4.6 | ○ | 4.5 | ○ | 78 | ○ | 60 | ○ | 99.2 | ○ | 99.4 | ○ |
| | Yellow | 42 | 46 | 4.1 | ○ | 4.0 | ○ | 50 | ○ | 25 | ○ | 99.6 | ○ | 99.7 | ○ |
| Exam. 2 | | 35 | 42 | 4.5 | ○ | 4.1 | ○ | 93 | ○ | 58 | ○ | 99.6 | ○ | 99.5 | ○ |
| Exam. 3 | | 33 | 42 | 4.7 | ○ | 4.3 | ○ | 115 | Δ | 60 | ○ | 96.5 | Δ | 98.0 | Δ |
| Exam. 4 | | 33 | 41 | 4.5 | ○ | 4.4 | ○ | 120 | Δ | 55 | ○ | 90.0 | Δ | 91.0 | Δ |
| Exam. 5 | | 35 | 46 | 4.2 | ○ | 3.9 | Δ | 220 | Δ | 95 | ○ | 99.0 | ○ | 99.3 | ○ |
| Exam. 6 | | 38 | 47 | 3.8 | Δ | 3.4 | Δ | 380 | Δ | 120 | Δ | 99.5 | ○ | 99.0 | ○ |
| Exam. 7 | | 36 | 55 | 4.2 | ○ | 3.1 | Δ | 460 | Δ | 380 | Δ | 97.5 | Δ | 98.6 | Δ |
| Exam. 8 | | 25 | 36 | 5.2 | Δ | 4.7 | ○ | 110 | Δ | 55 | ○ | 98.6 | Δ | 98.8 | Δ |
| Exam. 9 | | 30 | 35 | 4.6 | ○ | 4.3 | ○ | 85 | ○ | 60 | ○ | 96.0 | Δ | 98.8 | Δ |
| Comp. Exam. 1 | | 34 | 48 | 4.2 | ○ | 3.6 | Δ | 102 | Δ | 85 | ○ | 74.0 | X | 81.0 | X |
| Comp. Exam. 2 | | 28 | 35 | 4.8 | ○ | 5.0 | ○ | 110 | Δ | 230 | Δ | 68.0 | X | 72.0 | X |
| Comp. Exam. 3 | | 32 | 43 | 4.2 | ○ | 3.9 | Δ | 130 | Δ | 110 | ○ | 78.0 | X | 77.0 | X |
| Comp. Exam. 4 | | 23 | 29 | 5.5 | Δ | 4.9 | ○ | 750 | X | 830 | X | 98.5 | Δ | 99.0 | ○ |
| Comp. Exam. 5 | | 37 | 40 | 4.0 | ○ | 3.7 | Δ | 75 | ○ | 35 | ○ | 77.8 | X | 85.3 | X |

The developability is evaluated by making 10,000 copies using the developers under respective temperatures and humidity, leaving them standing overnight, copying an image having a 2 cm×5 cm patch at two points, and measuring a developing amount at hard stop. Two developing points on a photoreceptor are transferred onto a tape by using adhesiveness, the toner-adhered tape weight is measured, the tape weight is subtracted, and an average is taken to determine a developing amount (target is 4.0 g/m$^2$ to 5.0 g/m$^2$).

Fogging is evaluated by transferring the background portion onto the tape in the manner described above, and the number of toners in one square centimeter is counted. It is determined to use ○ when the number of toner particles is 100 or less, Δ when the number of toner particles is 100 to 500, and X when the number of toner particles is more than 500.

Transferability is evaluated by performing a hard stop at the end of the transfer step, transferring the toner weight on the two points of the intermediate transfer material onto the same type of tape as above, measuring the toner-adhered tape weight, subtracting the tape weight, taking an average to determine a transfer toner amount a, determining a toner amount b remaining on the photoreceptor in the same manner, and determining transfer efficiency by the same expression as above.

$$\eta 99\% \ldots ○,\ 90\% \leqq 99\% \ldots \Delta,\ \eta < 90\% \ldots X$$

In Example 4, the transfer efficiency is relatively low because the color particles A having a relatively uneven surface are used. In Examples 1 to 9, transferability is good initially and remained good after 10,000 copies are made. Fogging is small and images are clear. After making 10,000 copies, the photoreceptor is removed and its surface state is visually checked to find that occurrence of a flaw is few.

Meanwhile, in Comparative Examples 1 and 5, particles having a small particle size are added. Transfer efficiency is low even in the initial stage. In Comparative Example 3, resin particles having a wide particle size distribution are added. Transfer efficiency is initially good but became low after 10,000 copies are made. In Comparative Example 2, resin particles having a small gel ratio and insufficient hardness are added. Transfer efficiency is initially good but became low after 10,000 copies are made. In Comparative Example 4, positively charged resin particles are added. Transfer efficiency is initially good, but fogging is heavy after 10,000 copies are made.

Example 1 Kuro and Comparative Example 1 are studied by removing the cleaning blade of the above-described system and adding a brush instead, and changing the charging device to a roller charging device. As a result, the image in Example 1 is clear initially and remained clear even after 10,000 copies are made, and there is problems with the image. Meanwhile, when the developer of Comparative Example 1 is used, there is no problem initially, but it is found that toner remaining after the transfer produced a ghost on the next image. The charging roller is heavily contaminated, and image lines are caused by uneven charging.

Example 1 Kuro and Comparative Example 1 are also studied using a Scorotron charger without using the blade and the brush cleaning of the above-described system. Here, the image is clear initially and also clear after 10,000 copies are made, and no image problems are found in Example 1. Meanwhile, when the developer of Comparative Example 1 is used, there is no problem initially, but it is found that the toner remaining after the transfer produced a ghost on the next image. The toner remaining after the transfer accumulated to heavily contaminate the background, and the image quality is heavily degraded.

The surface material of the transfer belt is changed to PFA, and a device for heating from the back surface is added. Simultaneous transfer and fixing is then performed to produce four colors using the four colors of Example 1 and the configuration of Comparative Example 4, and are combined in various ways. High image quality with clearness very close to photo image quality could be obtained according to the Example. Meanwhile, there are scattering of thin lines, thickening of lines because of superposing of three colors, and an unsolid phenomenon (pinhole unprinted portions are formed in a solid print) of a character image according to the Comparative Example. Thus, image quality is inferior.

Respective toners are prepared by blending 100 parts of the above-described color particles B Kuro and 2 parts of the resin particles A to H using a Henschel mixer at a periphery speed of 32 m/s for ten minutes. The obtained toner is examined through a scanning electron microscope. Then, the above toner is stirred by a V-blender at 40 rpm for 20 minutes and observed through the scanning microscope to determine whether the resin fine particles are deformed by friction. As a result, it is found that the resin particles A to C and E to H are not deformed, and only the resin particles D are deformed. Thus, it is found that hardness of the resin particles is in correlation with the gel ratio of Table 1.

What is claimed is:

1. An electrostatic latent image developing toner, comprising:

toner particles containing a binder resin and a colorant, and resin particles having a volume mean diameter of 80 to 300 nm, a gel ratio of 60% or greater by weight, and a negative charged polarity with standard deviation of D50×0.20 or less, wherein:

the gel ratio=(weight of resin particles not dissolved into organic solvent/weight of resin particles used as sample)×100.

2. The electrostatic latent image developing toner according to claim 1, wherein:

the electrostatic latent image developing toner is a toner having a shape with a shape factor SF1 of 100 to 140, and the shape factor $SF1=ML^2/A\times100\pi/4$ (where, ML: absolute maximum length of toner particles, A: projected area of toner particles).

3. The electrostatic latent image developing toner according to claim 1, wherein the resin particles and the electrostatic latent image developing toner have the same charged polarity with respect to a charging member.

4. The electrostatic latent image developing toner according to claim 1, wherein the resin particles have a gel ratio of 80% or greater by weight.

5. The electrostatic latent image developing toner according to claim 1, wherein an inorganic compound having a size smaller than that of the resin particles and a volume mean diameter of 80 nm or less.

6. The electrostatic latent image developing toner according to claim 1, an added amount of the resin particles is in the range of 0.5 to 5 parts by weight to 100 parts by weight of the toner.

7. A two-component developer comprising a carrier and a toner, wherein the toner is the toner of claim 1.

8. The two-component developer according to claim 7, wherein the resin particles and the electrostatic latent image developing toner have the same charged polarity with respect to the carrier.

9. The two-component developer according to claim 7, wherein the carrier is a resin-coated carrier having a resin-coated layer containing a conductive material dispersed into a matrix resin, on a core material.

10. A method of producing an electrostatic latent image developing toner, comprising mixing resin particles having a volume mean diameter of 80 to 300 nm, a gel ratio of 60% by weight or more, and a standard deviation of D50×0.20 or less with toner particles containing a binder resin and a colorant, and adding to mix an inorganic compound having a size smaller than that of the resin particles with a share smaller than that of the previous mixing.

11. The method of producing an electrostatic latent image developing toner according to claim 10, wherein a volume average size of the inorganic compound having a size smaller than that of the resin particles is 80 nm or less.

12. The method of producing an electrostatic latent image developing toner according to claim 10, wherein an added amount of the resin particles is 0.5 to 5 parts by weight of the resin particles to 100 parts by weight of the toner.

13. An image-forming device, comprising a latent image holding member, charging means for charging the surface of the latent image holding member, latent image-forming means for forming an electrostatic latent image on the surface of the charged latent image holding member, developing means for developing the electrostatic latent image with a toner, and transfer means for transferring the toner image formed by developing onto a recording medium, wherein:

the toner is a toner containing toner particles consisting of a binder resin and a colorant, and resin particles having a volume mean diameter of 80 to 300 nm, a gel ratio of 60% by weight or more, and a standard deviation of D50×0.20 or less.

14. The image-forming device according to claim 13, wherein:

the toner consists of a cyan toner, a magenta toner, and a yellow toner respectively containing cyan, magenta, and yellow colorants, and the transfer means comprises means which temporarily transfer to superpose the respective color toner images formed by developing with the plurality of toners onto the transfer material and transferring the superposed color toner images onto the surface of the recording medium at one time.

15. The image-forming device according to claim 13, further comprising:

cleaning means for removing toner remaining on the latent image holding member after the transfer, wherein:

the cleaning means are means for recovering toner remaining on the latent image holding member using an electrostatic brush.

16. The image-forming device according to claim 13, further comprising recovering means which recover toner remaining on the latent image holding member into a developing unit without rubbing the latent image holding member by a blade.

17. An image-forming method, comprising a charge stage for charging the surface of a latent image holding member, a latent image processing stage for forming an electrostatic latent image on the surface of the charged latent image holding member, a developing stage for developing the electrostatic latent image with a toner, and a transfer stage for transferring the toner image formed by developing onto a recording medium, wherein:

the toner is a toner containing toner particles consisting of a binder resin and a colorant and resin particles having a volume mean diameter of 80 to 300 nm, a gel ratio of 60% by weight or more, and a standard deviation of D50×0.20 or less.

18. The image-forming method according to claim 17, wherein:

the toner consists of a cyan toner, a magenta toner, and a yellow toner respectively containing cyan, magenta and yellow colorants, and the transfer stage has a stage of temporarily transferring to superpose the respective color toner images, which are formed by developing with the plurality of toners, on a transfer material and transferring the superposed color toner images onto the surface of a recording medium at one time.

19. The image-forming method according to claim 17, further comprising a cleaning stage for removing toner remaining on the latent image holding member after the transfer, wherein:

the cleaning stage is a stage for recovering toner remaining on the latent image holding member by an electrostatic brush.

20. The image-forming method according to claim 17, further comprising a recovery stage for recovering the toner remaining on the latent image holding member into the developing unit without rubbing the latent image holding member using a blade.

* * * * *